US011253428B2

(12) United States Patent
Perrin et al.

(10) Patent No.: US 11,253,428 B2
(45) **Date of Patent: *Feb. 22, 2022**

(54) EMERGENCY WASH SYSTEM

(71) Applicant: Bradley Fixtures Corporation, Menomonee Falls, WI (US)

(72) Inventors: Timothy E. Perrin, Hartford, WI (US); Theodore E. Dhein, Sussex, WI (US); Scott M. Kluck, Mequon, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 64 days.

This patent is subject to a terminal disclaimer.

(21) Appl. No.: 16/726,521

(22) Filed: Dec. 24, 2019

(65) Prior Publication Data

US 2020/0129374 A1 Apr. 30, 2020

Related U.S. Application Data

(63) Continuation of application No. 15/645,649, filed on Jul. 10, 2017, now Pat. No. 10,517,796, which is a continuation of application No. 15/066,789, filed on Mar. 10, 2016, now Pat. No. 9,700,484, which is a continuation of application No. 12/876,819, filed on Sep. 7, 2010, now Pat. No. 9,314,398.

(Continued)

(51) Int. Cl.
*A61H 33/00* (2006.01)
*A61H 35/02* (2006.01)

(52) U.S. Cl.
CPC ..... *A61H 35/02* (2013.01); *A61H 33/6052* (2013.01); *A61H 33/6068* (2013.01)

(58) Field of Classification Search
CPC ..... A61H 35/02; A61H 35/008
USPC ..... 4/621, 624, 623, 627
See application file for complete search history.

(56) References Cited

U.S. PATENT DOCUMENTS 2,775,774 A 1/1957 Logan
2,999,249 A 9/1961 Logan et al.
(Continued)

FOREIGN PATENT DOCUMENTS

DE 26 39 449 12/1997
EP 2 276 444 3/2016
WO WO-2008/055111 A1 5/2008

OTHER PUBLICATIONS

International Search Report and Written Opinion for International Application No. PCT/US2010/047996, dated Dec. 6, 2010, 7 pages.
(Continued)

*Primary Examiner* — Lauren A Crane
(74) *Attorney, Agent, or Firm* — Foley & Lardner LLP

(57) ABSTRACT

An emergency wash system includes a basin, a fluid dispenser disposed at least partially over the basin, and a push plate coupled to the fluid dispenser. The push plate is positioned behind the fluid dispenser. The fluid dispenser includes: a fluid inlet portion defining a drainage aperture; a first fluid riser fluidly coupled to the fluid inlet portion, the first fluid riser extending upward from the fluid inlet portion; and a second fluid riser fluidly coupled to the fluid inlet portion, the second fluid riser extending upward from the fluid inlet portion on a substantially opposite side of the fluid inlet portion relative to the first fluid riser.

18 Claims, 21 Drawing Sheets

Related U.S. Application Data

(60) Provisional application No. 61/240,575, filed on Sep. 8, 2009.

(56) References Cited

U.S. PATENT DOCUMENTS

| | | | | |
|---|---|---|---|---|
| 3,090,050 | A | 5/1963 | Fraser et al. | |
| 3,599,251 | A | 8/1971 | Wright | |
| 4,012,798 | A | 3/1977 | Liautaud | |
| 4,585,175 | A | 4/1986 | Formentos | |
| 5,008,963 | A * | 4/1991 | Stein | A61H 35/02 239/16 |
| 5,201,726 | A * | 4/1993 | Kirkham | A61H 35/02 222/318 |
| 5,265,288 | A | 11/1993 | Allison | |
| 5,740,569 | A | 4/1998 | Gurries et al. | |
| 5,754,990 | A | 5/1998 | Gurries, II | |
| 6,205,599 | B1 * | 3/2001 | Anders | A61H 35/02 4/620 |
| 6,261,275 | B1 | 7/2001 | Hayes | |
| 7,305,722 | B2 | 12/2007 | Sha et al. | |
| 7,799,003 | B2 | 9/2010 | Johnson et al. | |
| D700,302 | S | 2/2014 | Eveleigh et al. | |
| D700,303 | S | 2/2014 | Eveleigh et al. | |
| 2005/0210578 | A1 | 9/2005 | O'Brien | |
| 2005/0273925 | A1 * | 12/2005 | Taylor | A61H 33/6068 4/620 |
| 2007/0204398 | A1 | 9/2007 | Dubois | |
| 2009/0288251 | A1 | 11/2009 | Strandberg et al. | |
| 2015/0113725 | A1 | 4/2015 | Eveleigh et al. | |

OTHER PUBLICATIONS

Stingray Systems Brochure No. 888-445-4142, believed to be publically available by Mar. 3, 2014, 6 pages.

* cited by examiner

EMERGENCY WASH SYSTEM

CROSS-REFERENCE TO RELATED PATENT APPLICATIONS

This application is a continuation of U.S. patent application Ser. No. 15/645,649, filed Jul. 10, 2017, which is a continuation of U.S. patent application Ser. No. 15/066,789, filed Mar. 10, 2016, which is a continuation of U.S. patent application Ser. No. 12/876,819, filed Sep. 7, 2010, which claims priority to U.S. Provisional Application No. 61/240,575, filed Sep. 8, 2009, all of which are incorporated herein by reference in their entireties.

BACKGROUND

The present application relates to an emergency wash system for flooding or rinsing of one or both of the eyes and/or the face of a person (e.g., a worker or other user) with water or a fluid solution in order to remove, dilute, or neutralize a contaminant or other foreign material.

SUMMARY OF THE INVENTION

One exemplary embodiment relates to an emergency wash system configured to dispense a fluid. The system comprises a receptacle and a dispenser assembly disposed at least partially over the receptacle. The dispenser assembly comprises a fluid inlet portion configured to extend in a substantially horizontal direction when in use and configured to be in fluid communication with a fluid supply. The dispenser assembly also comprises a first outlet portion defining at least one first discharge opening, a second outlet portion defining at least one second discharge opening, a first fluid riser extending upwardly and outwardly from the inlet portion towards the at least one first discharge opening and a second fluid riser extending upwardly and outwardly from the inlet the first fluid riser towards the at least one second discharge opening on a side of the fluid inlet portion opposite the first fluid riser.

Another exemplary embodiment relates to an emergency wash system configured to dispense a fluid. The system comprises a receptacle having a flood-level rim and a fluid dispenser disposed at least partially over the receptacle. The fluid dispenser has a housing defining a fluid inlet portion configured to be coupled to a fluid supply line, a fluid outlet portion configured to direct fluid towards a user, and a drain. The drain comprises an opening through which the fluid is configured to self-drain by gravity. The drain is supported above the flood-level rim.

Another exemplary embodiment relates to an emergency wash system configured to dispense a fluid. The system comprises a sprayhead having a central inlet portion and first and second arms extending from the central inlet portion. The first and second arms each defining at least one discharge opening configured to direct the fluid towards a user. The system further comprises a first cover coupled to the first arm and moveable between a first position and a second position to conceal and reveal the at least one discharge opening of the first arm and a second cover coupled to the second arm and moveable between a third position and a fourth position to conceal and reveal the at least one discharge opening of the second arm.

Figure 1:
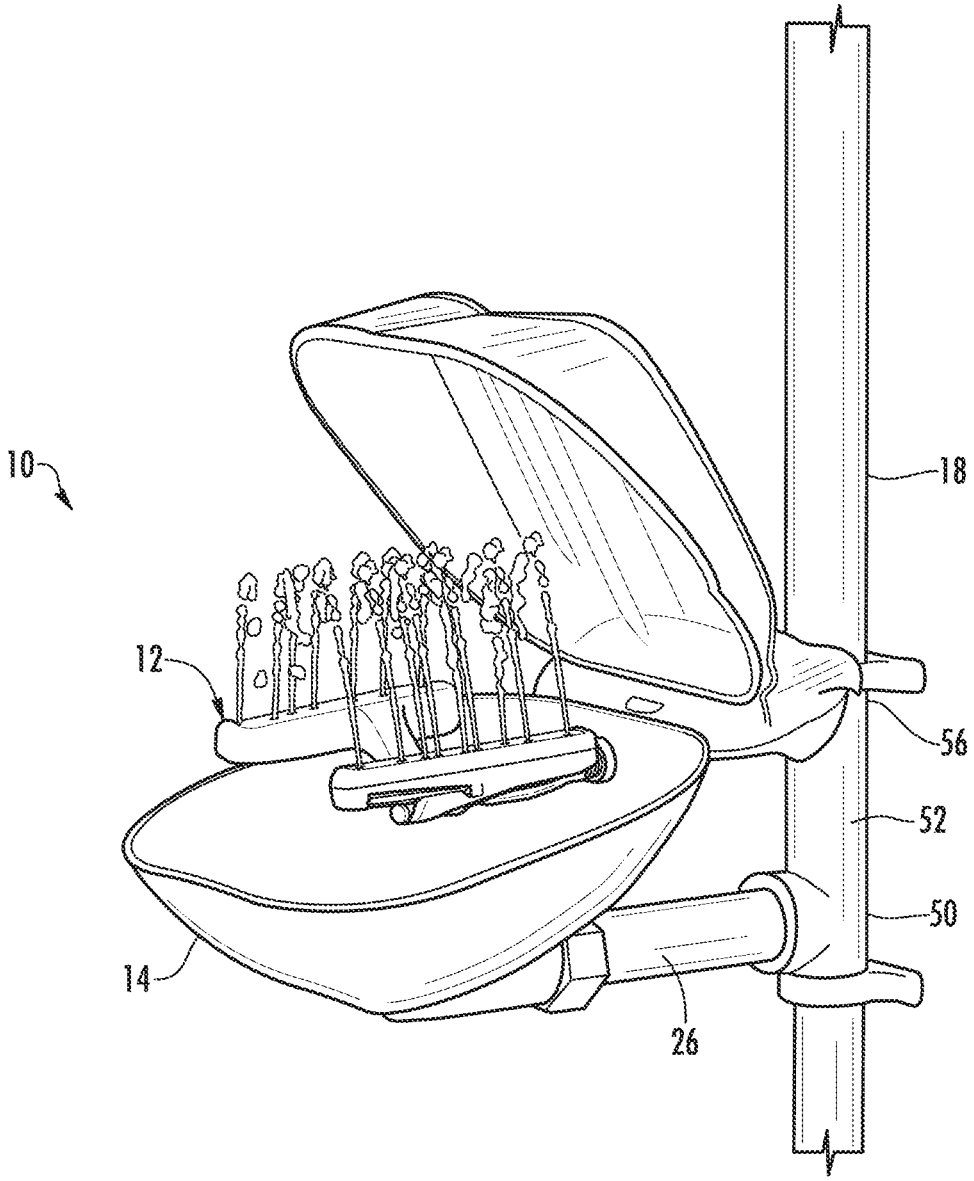
FIG. 1 is an isometric view of the emergency wash system according to an exemplary embodiment shown in a use position.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION

Figure 2:
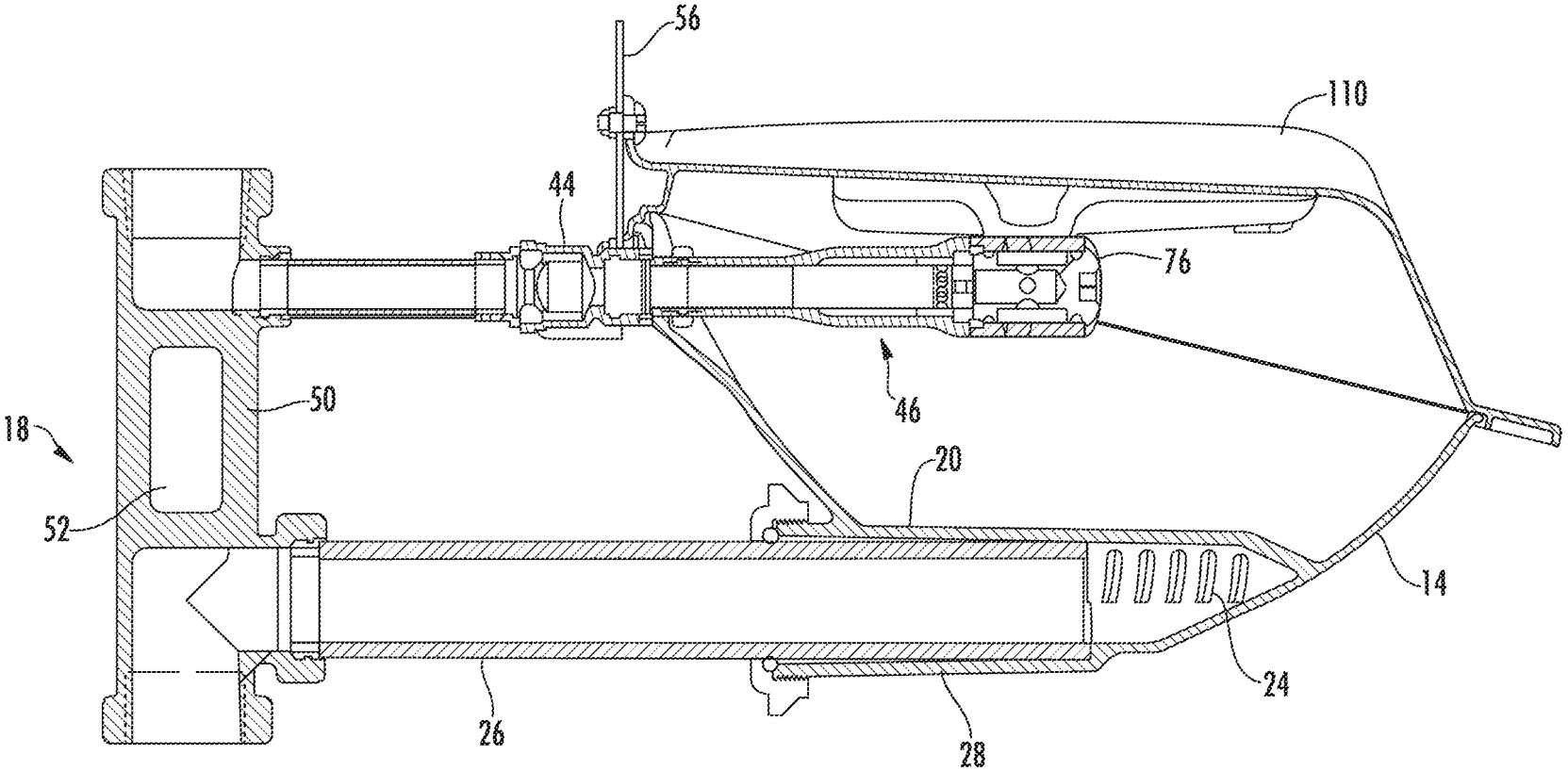
FIG. 2 is a sectional view of the emergency wash system of FIG. 1 shown in a non-use position.

Referring generally to the Figures, an emergency wash system 10 and components thereof are shown according to exemplary embodiments. The emergency wash system 10 may be installed in laboratories or other environments where hazardous conditions due to fire or chemicals may be present. The emergency wash system 10 is selectively moveable between a non-use or stowed position (shown in FIG. 2) and a use or deployed position (shown in FIG. 1). In the use position, the emergency wash system 10 is configured to flood or rinse one or both of the eyes and/or the face of a person (e.g., a worker or other user) with water or a fluid solution in order to remove, dilute, or neutralize a contaminant or other foreign material on the user. It should be noted that while the emergency wash system 10 will be described as delivering water to the user, the emergency wash system 10 may be used with any suitable solution for washing the eyes and/or face of a user.

The emergency wash system 10 disclosed herein may provide one or more of a number of advantageous features. For example, the emergency wash system 10 may separate the fluid supply line from the fluid waste line thereby reducing the likelihood of cross-contamination. Also, the emergency wash system 10 may simplify the actuation of the system for a user by directly coupling a user interface, (e.g., a push plate and/or a cover, etc.) to a valve that controls the flow of water to a sprayhead. Further, the emergency wash system 10 may provide a single user interface (e.g., push plate, handle, etc.) that will accommodate both right-handed users and left-handed user without any adjustments being made. Further still, the emergency wash system 10 may allow for modularity by providing a platform that can readily accept different sprayhead options depending on the application. For example, a sprayhead designed to wash the eyes and face of a user may be configured to be readily interchanged with a sprayhead designed to wash just the eyes of a user without making any other adjustments to the system. Further still, the emergency wash system 10 may provide a basin that is capable of being supported by a drain pipe coupled to the basin thereby eliminating the need to provide additional support for the basin. In such an embodiment, the drain pipe may exit the basin at a substantially horizontal orientation. Further still, the emergency wash system 10 may provide a sprayhead that is self-draining and designed to eliminate the pooling of stagnant water within the system. For example, the sprayhead may include a weep hole that is designed to be above a flood rim of the basin. Further still, the emergency wash system 10 may provide a sprayhead that can directionally control the flow of the stream exiting the sprayhead without requiring a nozzle or an angled hole in the sprayhead by providing one or more ramps within a passageway leading to aperture in the surface of the sprayhead. Further still, the emergency wash system 10 may provide dust covers that are configured to stay on the sprayhead even if the sprayhead is being used in a swing-down application and is being stowed in a substantially vertical position by angling the axis of rotation of the dust cover relative to a centerline of the sprayhead. Further still, the emergency wash system 10 may be more cost effective to manufacturer and service because it reduces the number of fittings, components, etc. The emergency wash system 10 may include one or more of the above-referenced features alone or in any combination of features. Further, the emergency wash system 10 may include features in addition to those referenced above and disclosed in the present disclosure.

Figure 3:
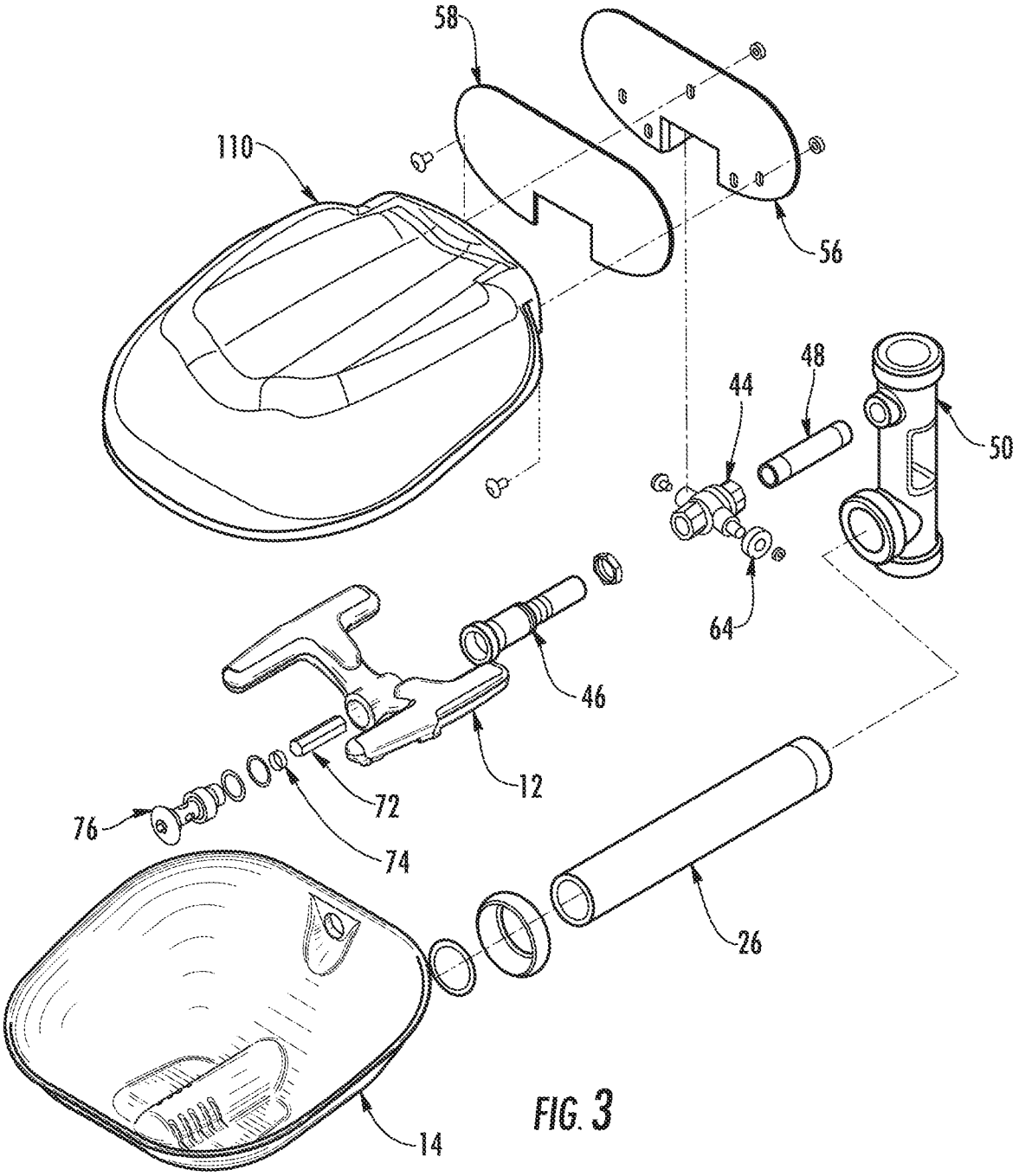
FIG. 3 is an exploded view of the emergency wash system of FIG. 1.
Figure 4:
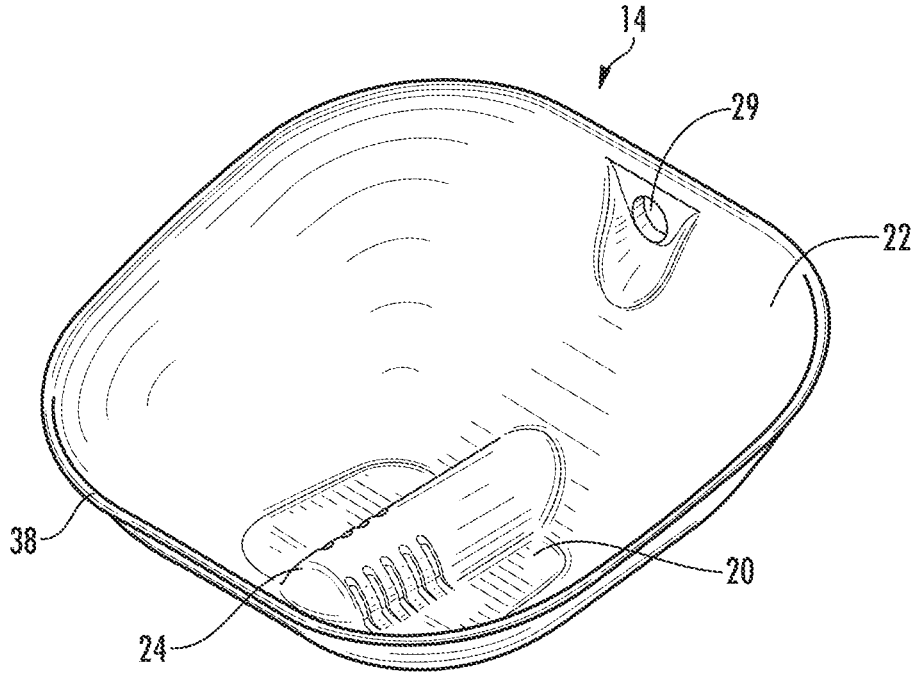
FIG. 4 is an isometric view of a basin of the emergency wash system of FIG. 1 shown according to an exemplary embodiment.
Figure 5:
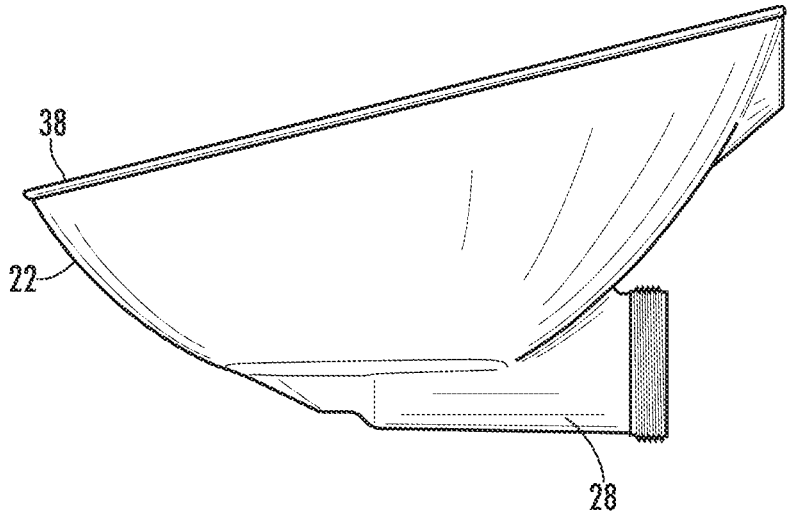
FIG. 5 is a side view of the basin of FIG. 4.
Figure 6:
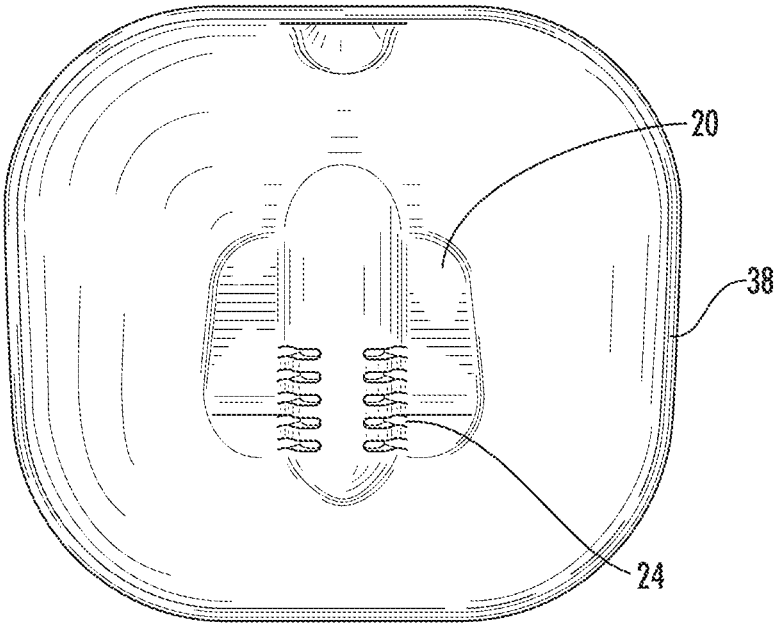
FIG. 6 is a top view of the basin of FIG. 4.
Figure 7:
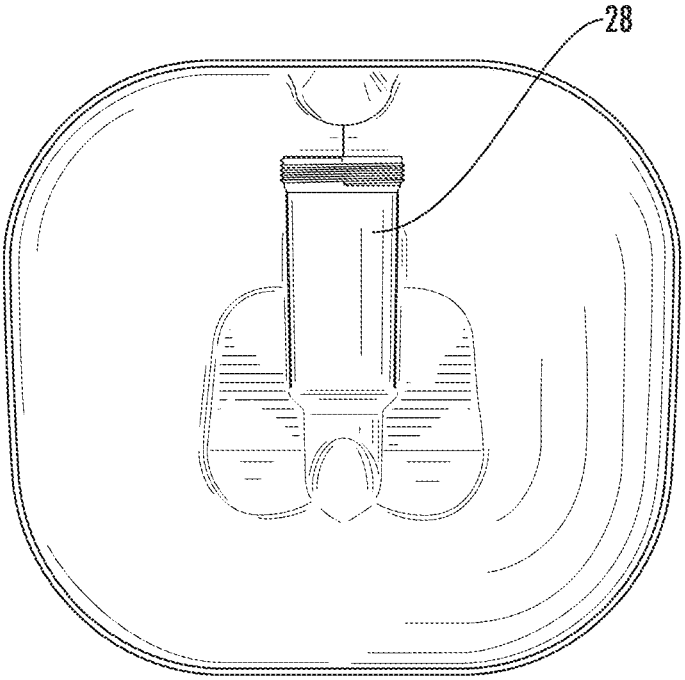
FIG. 7 is a bottom view of the basin of FIG. 4.
Figure 8:
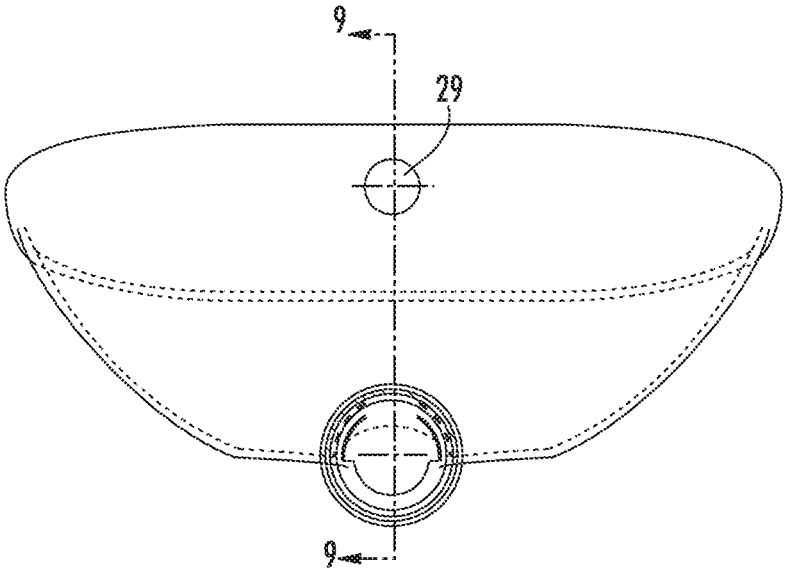
FIG. 8 is a back view of the basin of FIG. 4.
Figure 9:
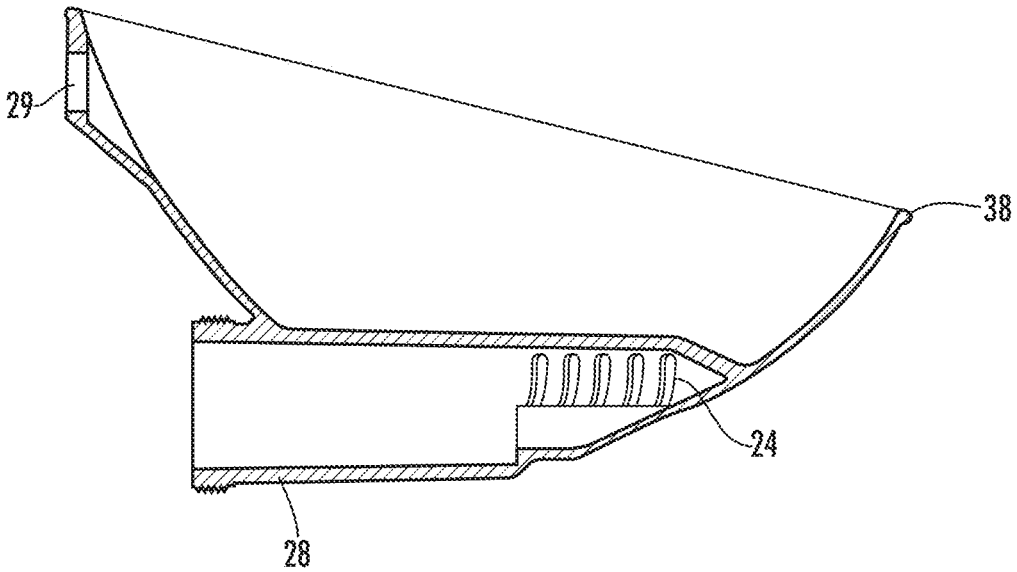
FIG. 9 is a sectional view of the basin of FIG. 4 taken along line 9-9 in FIG. 8.

Referring to FIG. 3, the emergency wash system 10 generally comprises a fluid dispenser (e.g., outlet, nozzle, etc.), shown as a sprayhead 12, that is disposed over a receptacle (e.g., bowl, sink, etc.), shown as a basin 14, and configured to be controlled by a valve 44 that is in fluid communication with a fluid supply portion of a plumbing assembly 18.

Referring to FIGS. 4 through 9, the basin 14 is shown as being bowl-shaped with an upwardly open geometry defining a lower floor 20 and an upwardly projecting side wall 22 for receiving and collecting water for subsequent flow through a drain 24 and a drain conduit 26 (e.g., tailpiece, etc.) to a suitable drain site. The basin 14 is adapted for mounting onto the plumbing assembly 18, although it will be understood that other mounting positions and structures may be provided such as mounting the basin to a wall by means of a mounting bracket or the like. According to the embodiment illustrated, the basin 14 is a substantially rectangular bowl. Such a shape minimizes the overall size of the system while still providing sufficient collection of the waste water. According to the various alternative embodiments, the basin may be provided in any of a number of shapes (e.g., circular, triangular, oval, etc.).

Provided at the lower floor 20 of the basin 14 is a passageway 28 having a first end 30 defining the drain 18 and a second end 32 configured to receive the drain conduit 26. The passageway 28 extends in a substantially horizontal orientation relative to the orientation of the emergency wash station 10 when installed. The passageway 28 is long enough so that a significant portion of the drain conduit 26 is received within the passageway 28. For example, the passageway 28 may have a length sized to receive between approximately three (3) inches to approximately eight (8) inches of the drain conduit 26. Having such a large portion of the drain conduit 26 be received within the basin 14 at such a horizontal orientation, allows the drain conduit 26 (which is fixedly supported by the plumbing assembly 18) to support the weight of the basin 14. As such, secondary support members, such as an additional support bracket, may not be needed to support the emergency wash system 10 because the drain conduit 26 supports the weight of the basin 14. To help seal the connection between the drain conduit 26 and the passageway 28, a seal 36 (e.g., gasket, etc.) may be provided.

According to the embodiment illustrated, the outer contour of the passageway 28 is seen from the inside of the basin 14 and may help direct the waste water towards the drain 18. Such a configuration may assist in preventing waste water from collecting (e.g., puddling, etc.) on the bottom the lower floor 20. To secure the drain conduit 26 to the basin 14, the second end 32 of the passageway 28 includes a threaded protrusion configured to receive a coupling device 34 (e.g., thread nut, etc.).

The sidewall 22 upwardly extends from the lower floor 20 and includes an edge 38 extending around the periphery of the sidewall 22. The edge 38 is an upper edge that defines the flood-level rim (i.e., flood rim) of the basin 14. The flood rim defines the height at which water will begin to empty from the basin 14 if the basin 14 is filled beyond capacity. According to an exemplary embodiment, a front portion (e.g., edge, etc.) of the edge 38 is provided at a different (e.g., lower, etc.) height than a rear portion of the edge. According to the embodiment illustrated, the basin 14 slopes downward at a relatively constant angle between the rear portion and the front portion. Such a configuration may encourage a user to lean into the basin 14 and properly position themselves over the sprayhead 12. Providing a basin with an angled top edge rather than a basin having a top edge that is lower all the way around the basin may also improve the ability of the basin to collect water that may splash around when the emergency wash system 10 is in use. Further, by providing the basin 14 with a higher back portion, the basin 14 itself is able to function as a backsplash for the emergency wash system 10, which may help keep water from spilling onto the floor.

The higher back portion of the basin 14 also provides an entry point 29 for the fluid supply portion of the plumbing assembly 18 that is inside the basin 14 instead of above the basin 14. Providing an entry point in the basin 14, rather than above the basin 14, may improve the ability of the basin 14 to collect water that may splash around when the emergency wash system 10 is in use and/or may simplify the coupling of an optional cover 110 to the basin 14. As detailed below, the fluid supply portion of the plumbing assembly 18 enters the basin 14 at a substantially horizontal orientation that may be substantially parallel to the portion of drain conduit 26 within passageway 28.

The plumbing assembly 18 supplies and drains fluid from the basin 14 and generally includes an fluid inlet portion or subassembly 40 and a fluid outlet portion or subassembly 42. The fluid inlet subassembly is separated from the fluid outlet portion so that the fluid supply line is distinct from the fluid waste line. Such a configuration may help protect against cross-contamination (e.g., waste water entering the fluid inlet conduit) between the fluid waste and the fluid supply.

Figure 10:
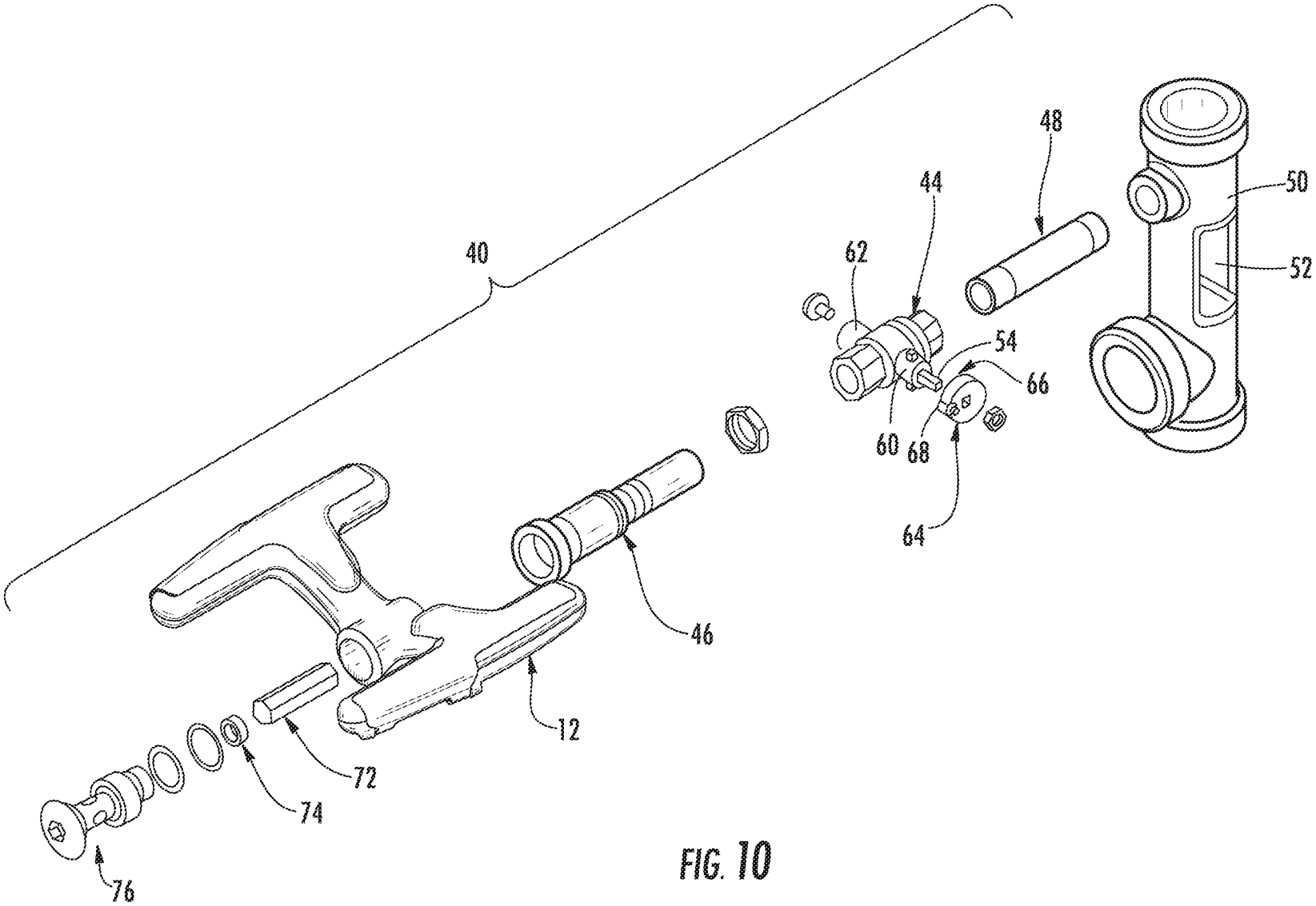
FIG. 10 is an exploded view of a fluid inlet assembly of the emergency wash system of FIG. 1 shown according to an exemplary embodiment.
Figure 11:
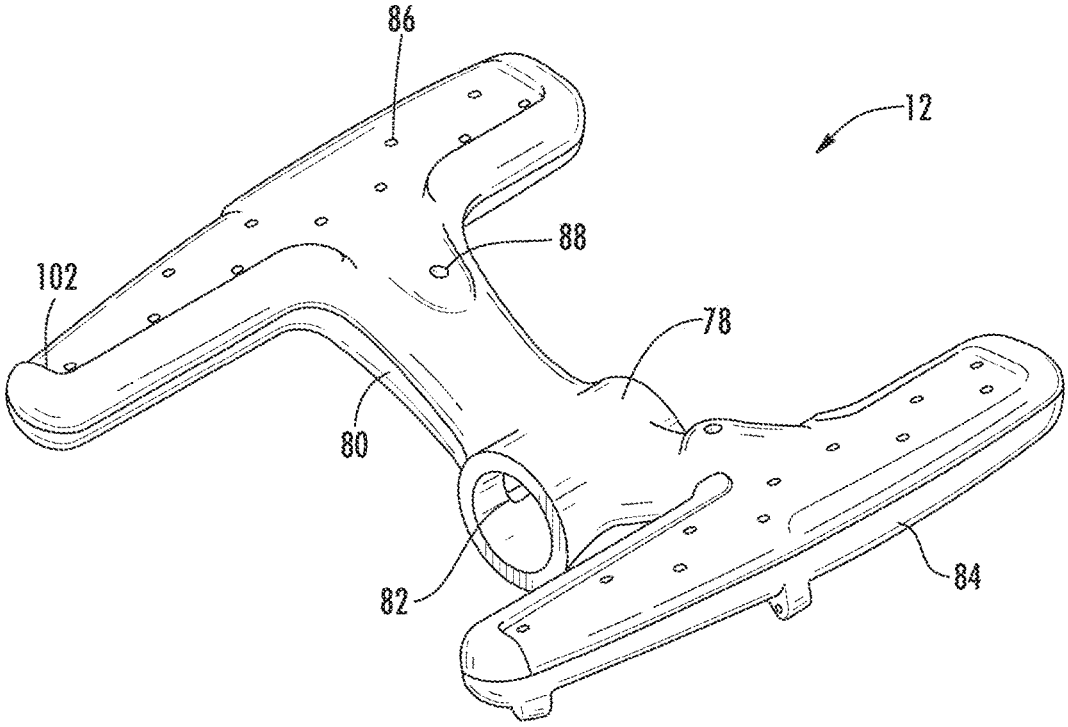
FIG. 11 is an isometric view of a face and eyewash sprayhead for the emergency wash system of FIG. 1 shown according to an exemplary embodiment.
Figure 12:
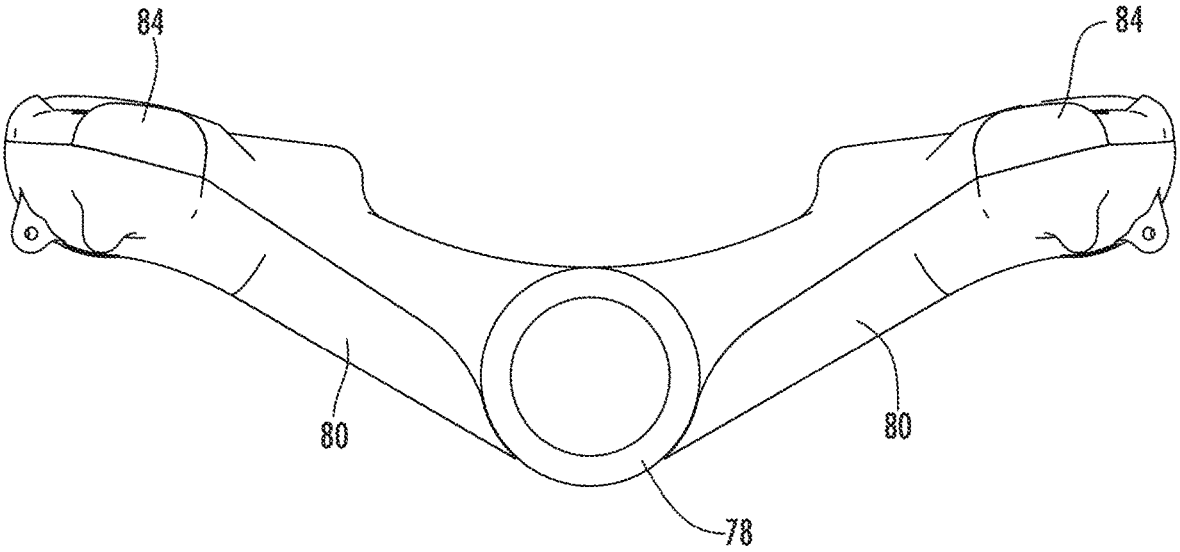
FIG. 12 is a front view of the face and eyewash sprayhead of FIG. 11.
Figure 13:
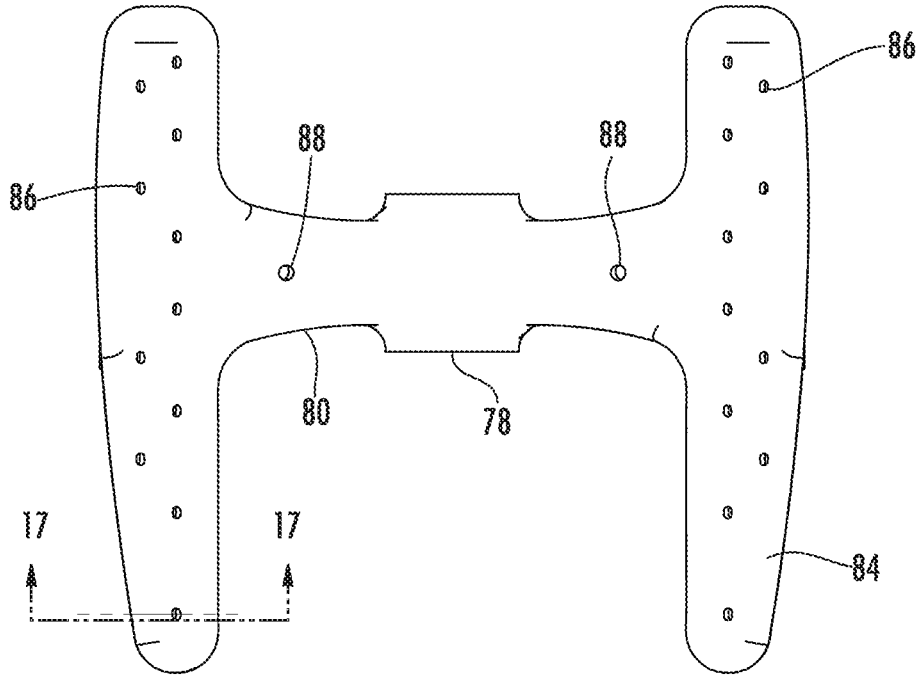
FIG. 13 is a top view of the face and eyewash sprayhead of FIG. 11.
Figure 14:
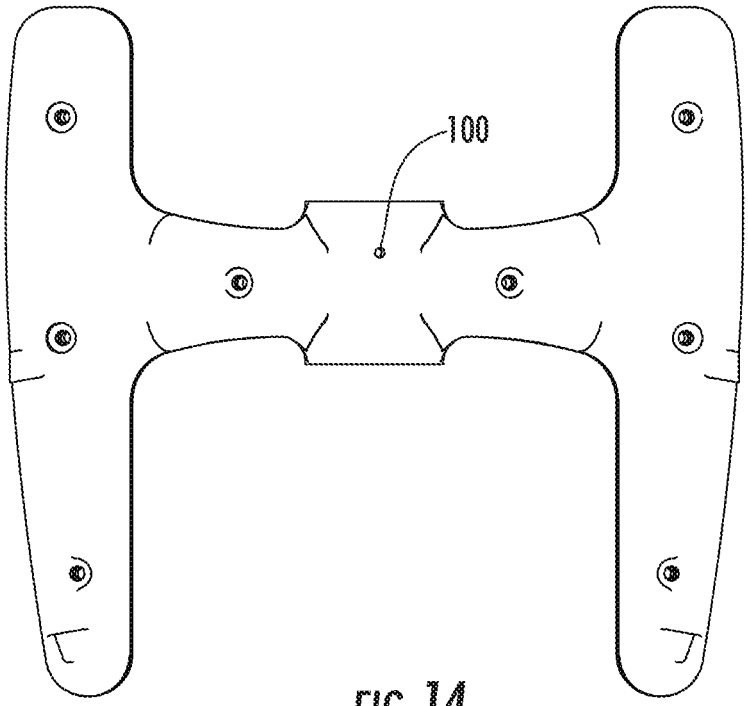
FIG. 14 is a bottom view of the face and eyewash sprayhead of FIG. 11.
Figure 15:
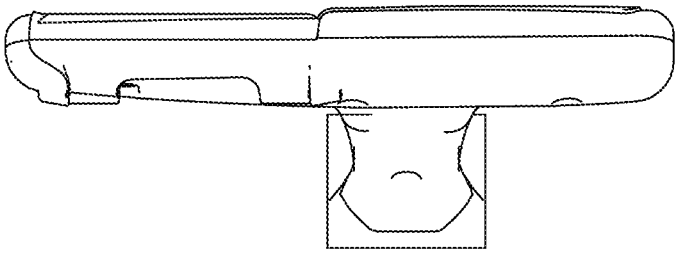
FIG. 15 is a side view of the face and eyewash sprayhead of FIG. 11.

Referring to FIG. 10, the fluid inlet subassembly 40 generally comprises a fluid inlet line, a valve 44 having a first end configured to be in fluid communication with the fluid inlet line and a second end configured to be in fluid communication with a coupler 46. The fluid inlet line may be comprised of one or more fittings (e.g., pipes, conduits, elbows, etc.) configured to direct water towards the valve 44. According to the embodiment illustrated, the fluid inlet line includes a pipe 48 having a first end coupled to an elbow and a second end coupled to the valve 44. The elbow is shown as being integrally formed with an elbow of the fluid outlet subassembly to form a fitting 50. Integrally forming the fitting 50 for the fluid supply and the fitting for the fluid waste may reduce the overall number of components needed for the system. An opening or window 52 is provided in the fitting 50 to provide visual assurance that the fluid supply is separate from the fluid waste.

The valve 44 is coupled to the second end of the pipe 48 and includes a valve body mounted in line with the pipe 48. The valve body supports a valve member, such as a ball valve or the like, and a valve stem 54 for controlling the movement of ball valve within the valve body. The valve 44 is selectively moveable between an open position and a closed position by rotating the valve stem 54. When the valve 44 is open, water under pressure flows through the fluid inlet line and into the sprayhead 12 to provide a flush flow for flushing irritants from the eyes and/or face of a user.

The valve 44 is activated by a mechanism (shown as a push plate 56, but may be a lever, button, or the like), that allows water or another substance to flow through plumbing assembly 18 to emerge from the sprayhead 12. Referring back to FIGS. 2 and 3, the push plate 56 includes a visible and accessible enlarged flat area that is fixedly mounted relative to the valve stem 54 of the valve 44 so that movement of the flat area of the push plate 56 causes the push plate 56 to rotate the valve stem 54. Indicia, such as indicia provided on a decal 58, may be added to the push plate 56 to help instruct a user trying to activate the emergency wash system 10 to push the push plate 56.

The push plate 56 is movable between a first position and a second position. According to the embodiment illustrated, the push plate 56 is rotatable between the first position and the second position about an axis that is defined by the rotational axis of the valve stem 54. At the first position of the push plate 56, the push plate 56 is substantially vertically disposed and the valve 44 is closed. At the second position of the push plate 56, the push plate 56 is angularly offset from the first position and the valve 44 is open. For example, the push plate 56 may be substantially horizontally disposed when in the second position. As such, the valve 44 is closed in response to moving the push plate 56 to the first position, and the valve 44 is opened in response to moving the push plate 56 to the second position.

According to an exemplary embodiment, the push plate 56 is centrally located behind the basin 14. Centrally positioning the push plate 56 relative to the basin 14, rather than providing a push plate to the left or right side of the basin 14, may advantageously accommodate left handed and right handed users. Such a configuration may also provide a more compact system by eliminating the need for additional clearance on the left or right side of the system for the user interface.

Referring back to FIG. 10, to support the push plate 56, the valve body includes in a first projection 60 extending from a first side (e.g., a right side, etc.) of the valve and a second projection 62 extending from a second side (e.g., a left side, etc.) of the valve 44. One of the first projection 60 and the second projection 62 supports the valve stem 54. The other projection is added to provide additional support for the push plate 56 and/or a cover. Because the push plate 56 is provided behind the basin 14 and extends outward from both the right and left sides of the basin 14, the push plate 56 is coupled to the valve 44 at both the first projection 60 and the second projection 62. By providing an additional projection on the valve 44, the force being exerted between the valve 44 and the push plate 56 when push plate 56 is actuated is more evenly distributed rather than being focused on one side of the valve 44 and/or one portion of the push plate 56. According to the embodiment illustrated, the first and second projections 60, 62 are cylindrical members having substantially circular cross sections.

To facilitate the coupling of the push plate 56 to the valve stem 54, an adapter 64 is provided. The push plate 56 is fixedly coupled to the adapter 64. The adapter 64 defines an aperture having a contour that substantially corresponds to the outer contour of the valve stem. The adapter 64 is installed by inserting the valve stem 54 into the aperture. Once inserted, the movement of the valve stem 54 is synchronized with the movement of the adapter 64 (and thus the push plate 56 and/or cover 110). Outwardly extending from a first side of the adapter 64 is a first stop member 66 and a second stop member 60. The first and second stop members 66, 68 of the adapter 64 are configured to engage corresponding stop members provided on either the first or second projections of the valve body. The first and second stop members 60, 68 are used to control the range of rotational movement of the push plate 56 relative to the valve 44.

According to an exemplary embodiment, the push plate 56 and/or the cover 110 (detailed below) may be biased to the first position and/or the second position. For example, one or more biasing elements, such as a spring (e.g., torsion spring, coil spring, etc.) may be provided between the valve body and the push plate 56 to assist a user in moving the push plate 56 to the first position and/or the second position (e.g., to assist in opening and/or closing the valve 44, etc.).

Still referring to FIG. 10, the coupler 46 is coupled to the outlet side of the valve 44 and is configured to support and/or receive the sprayhead 12. The coupler 46 generally comprises a main body portion 70, strainer 72, a flow control device 74 and a plug or cap 76. According to the embodiment illustrated, the coupler 46 is provided within the periphery of the basin 14. As such, the strainer 72 and the flow control device 74 are both supported over the basin 14 rather than being provided somewhere else in the plumbing system 18 further upstream. Such a configuration simplifies the system and may provide for easier maintenance, less components and/or a smaller footprint (less clearance) for the emergency wash system 10.

The main body portion 70 of the coupler 46 defines a bore extending between a first open end and a second open end. When the fluid inlet subassembly is assembled, the strainer 72 and the flow control device 74 are supported within the bore. Such a configuration integrates a strainer 72 and a flow control device 74 into a single assembly. The strainer 72 is configured to remove particles (e.g., sand, grit, rust flakes, etc.) that may be suspended in the water before the water reaches the sprayhead 12. Inclusion of the strainer 72 may reduce the likelihood that the apertures in the sprayhead 12 will become clogged and have to be cleaned out. According to the various alternative embodiments, a filter may also be added to purify or otherwise treat the water before reaching the sprayhead 12. To prolong the functionality of such a filter, it may be desirable to position the filter subsequent (e.g., downstream) of the strainer 72. According to the embodiment illustrated, the strainer 72 is a mesh tube having a substantially circular cross section. The water coming from the fluid inlet conduit surrounds the outer periphery of the strainer 72 and passes through the meshing. The flow control device 74 is provided at an end of the strainer 72 so that at least a significant portion of the water must first pass through the strainer 72 before reaching the flow control device 74. This helps prolong the life of the flow control device 74 (and reduce the amount of maintenance that would otherwise have to be performed to remove particles from the flow control device). The size of the openings in the strainer 72 (e.g., the size of the meshing for the embodiment illustrated) may vary depending on the application and/or on the location that the emergency wash system 10 is being installed.

If maintenance needs to be conducted on the strainer 72 (e.g., to clean the strainer or replace the strainer, etc.), the cap 76 can simply be removed from the coupler 46 to provide access to the strainer 72 without having to disassemble the entire fluid inlet assembly.

The flow control device 74 is a flow regulator configured to maintain a generally constant flow rate at a range of pressures. The flow control device 74 includes an outer member with a central opening and an inner member that nests within outer member. A resilient member, such as an o-ring or other gasket, is trapped between the end walls of the inner member and the outer member on the downstream side of the flow control device 74. As the pressure difference across the flow control device 74 increases (e.g., between the upstream and downstream sides) the o-ring is forced into the central opening of the flow control device 74, thereby reducing (e.g., controlling) the flow rate of liquid through the flow control device 74. As the pressure difference is reduced, the o-ring retracts from the central opening and forces the inner member upstream.

According to the various alternative embodiments, the flow control device 74 may not be housed within the main body portion 70 of the coupler 46, but instead may be provided further upstream or within the sprayhead 12. According to other exemplary embodiments, flow control device 74 may be a different volume control element such as a valve.

The sprayhead 12 is received at the second free end of the main body portion 70 and the cap 76 is then coupled to the coupler 46 in a manner that traps or otherwise retains the sprayhead 12 on the coupler 46. The cap 76 functions as a plug so that water passing through the fluid inlet conduit and the main body portion 70 is directed into the sprayhead 12. The cap 76 includes a sidewall that defines an elongated bore and an end wall that includes a coupling element. After the water passes through the strainer and the flow control device, the water enters the elongated bore of the cap 76. The water then directed through one or more apertures in the sidewall of the cap into the sprayhead.

The coupler 46 serves as a platform for supporting a number of different sprayheads 12. For example, in a first application it may be desirable to use a sprayhead designed to wash the face and eyes of a user, while in a second application it may be desirable to use a sprayhead designed to wash just the eyes of user. The coupler 46 is configured to readily accept these different sprayheads without requiring any further adjustments be made to the system. In such a system, the same fluid pressure would be used with the different sprayheads. Such a configuration allows for a modular emergency wash system capable of accepting interchangeable sprayheads.

Referring to FIGS. 11-45, the sprayhead 12 is shown according to an exemplary embodiments. The sprayhead 12 shown in FIGS. 11-31 is configured to flood or rinse both of the eyes and the face of the user with fluid when the emergency wash system 10 is activated. Such a sprayhead 12 is in contrast to the sprayhead 12 shown in FIGS. 32-45, which is configured to flood or rinse just the eyes of the user with fluid when the emergency wash system 10 is activated. Both embodiments are configured to provide a more thorough and/or uniform spray pattern, and are intended to meet both United States (e.g., local, state and/or federal) and European specifications and provide an improved wash down.

The sprayhead 12 includes an internal fluid passageway for moving water received from the valve 44 to an outlet port or aperture on the sprayhead. According to an exemplary embodiment, the sprayhead 12 includes a main housing or body, shown as a central hub 78 and first and second fluid riser portions 80 upwardly and outwardly extending from the hub 78. The hub 78 includes a sidewall defining a bore having a first end configured to be coupled to the main body portion of the coupler 46 and a second end configured to receive the cap 76. The sidewall further defines a first aperture 82, which fluidly couples the bore to the first fluid riser, and a second aperture 82, which fluidly couples the bore to the second fluid riser. The internal fluid passageway within the first and second fluid riser portions 80 extends upwardly and outwardly from the internal fluid passageway of the hub 78. According to an exemplary embodiment, the internal fluid passageway within the first and second fluid riser portions 80 extends upwardly and outwardly from the internal fluid passageway of the hub 78 in an orientation that is substantially perpendicular to the internal fluid passageway of the hub 78.

According to the embodiment shown in FIGS. 11-31, the sprayhead further includes first and second elongated portions 84 (e.g., arms, wings, etc.) supported at the first and second fluid riser portions 80 respectively. According to an exemplary embodiment, the first and second elongated portions 84 are supported at an orientation that is substantially parallel with the hub 78. According to the embodiment illustrated, the first and second elongated portions 84 cooperate with the first and second fluid risers to define a substantially H-shaped sprayhead. Such a configuration may provide improved wash down by applying the fluid to a greater portion of a user's face. This is achieved by having the first and second elongated portions 84 substantially follow the side contours of a typical users face.

On a top surface of the sprayhead 12, one or more apertures, (e.g., ports, orifices, etc.) are provided for directing the water flowing sprayhead towards the user. According to the embodiments illustrated, a plurality of apertures are provided. The placement and configuration of the apertures control the displacement of the water from the sprayhead 12. The stream of the water exiting the sprayhead 12 is intended to flush any irritants away from the susceptible portions on a user face (e.g., eyes, nose, mouth, etc.). According to the embodiment illustrated in FIGS. 11-31, a first series of apertures 86 are provided in the first and second elongated portions 84 and a second series of apertures 88 are provided in the first and second fluid risers 80. The apertures 86 on the first and second elongated portions 84 are designed to wash down the face of a user, while the apertures 88 on the first and second fluid risers 80 are designed to wash down the eyes of a user. As such, the sprayhead 12 shown in FIGS. 11-31 has certain apertures designated for washing down the face and certain apertures designated for washing down the eyes.

According to an exemplary embodiment, the apertures are configured to directionally dispense the water. The direction in which the apertures dispense the water may not be the same for each aperture. For example, some apertures may be configured to provide a more vertical stream of water, while others are configured to provide a more angled stream of water. The angle at which the apertures may directionally dispense the water may include a first angular component (allowing for side to side variations in stream angles) and/or a second angular component (allowing for front to back variations in stream angles).

At the surface of the sprayhead 12, the aperture is defined by a substantially straight edge or sidewall defining an axis of the aperture. The cross section shape of the apertures at the surface of the sprayhead 12 may vary depending on the application. For example, the apertures configured to wash the face of a user are shown as having substantially rectangular cross sections, while the apertures configured to wash the eyes of a user are shown as having substantially circular cross sections.

Figure 16:
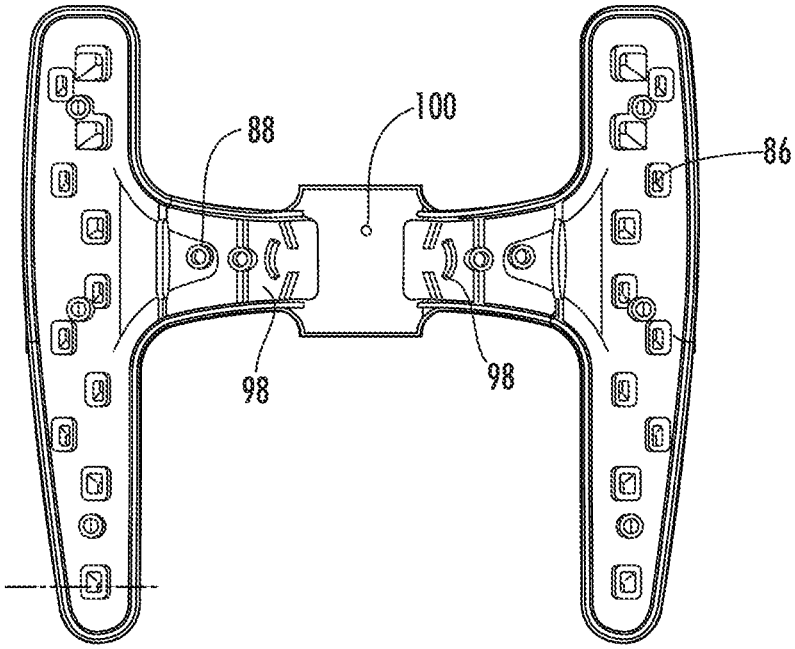
FIG. 16 is a bottom view of a top portion of the face and eyewash sprayhead of FIG. 11.
Figure 17:
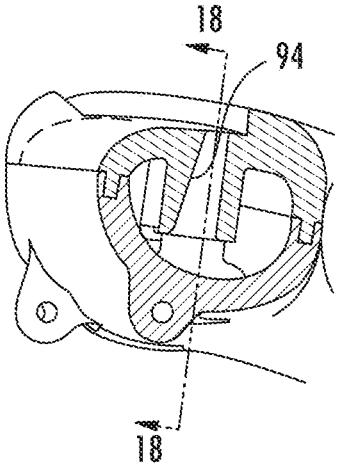
FIG. 17 is a sectional view of the face and eyewash sprayhead of FIG. 11 taken along line 17-17 in FIG. 13.
Figure 18:
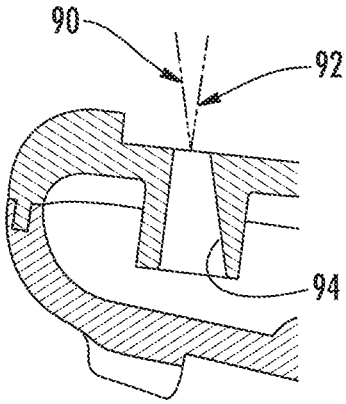
FIG. 18 is another sectional view of the face and eyewash sprayhead of FIG. 11 taken along line 18-18 in FIG. 17.
Figure 19:
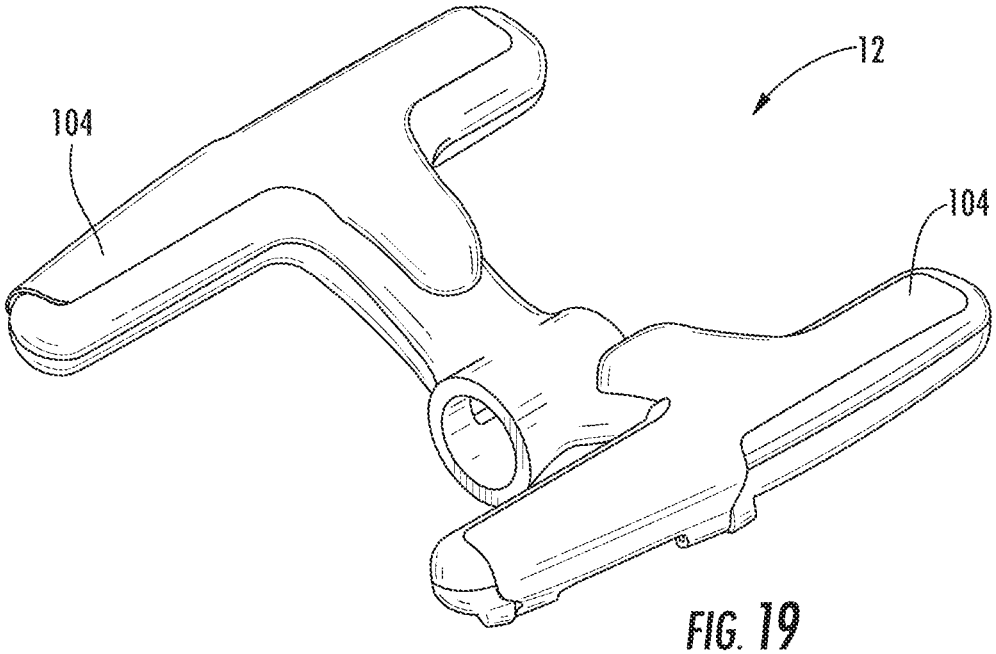
FIG. 19 is an isometric view of the face and eyewash sprayhead of FIG. 11 shown with a pair of dust covers in a closed position according to an exemplary embodiment.
Figure 20:
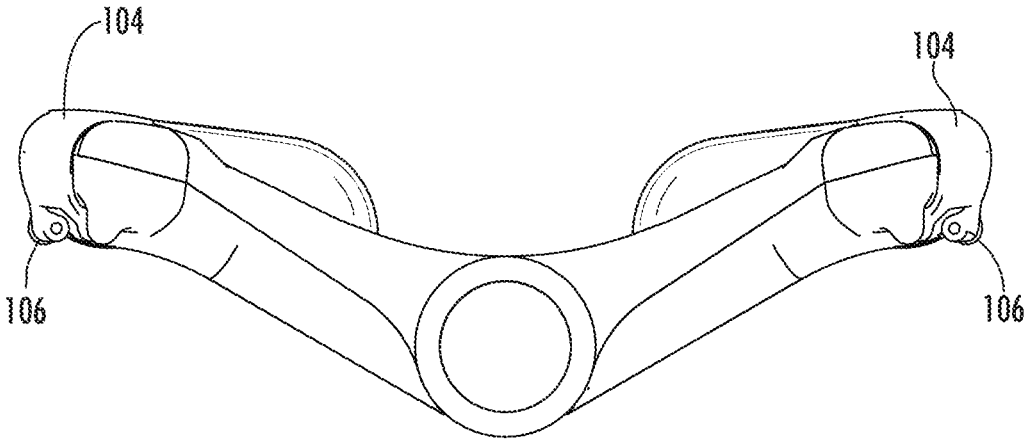
FIG. 20 is a front view of the face and eyewash sprayhead of FIG. 19.
Figure 21:
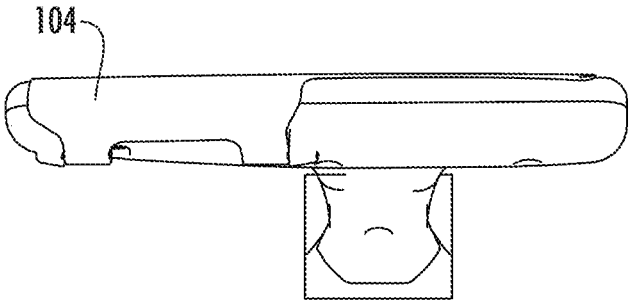
FIG. 21 is a side view of the face and eyewash sprayhead of FIG. 19.
Figure 22:
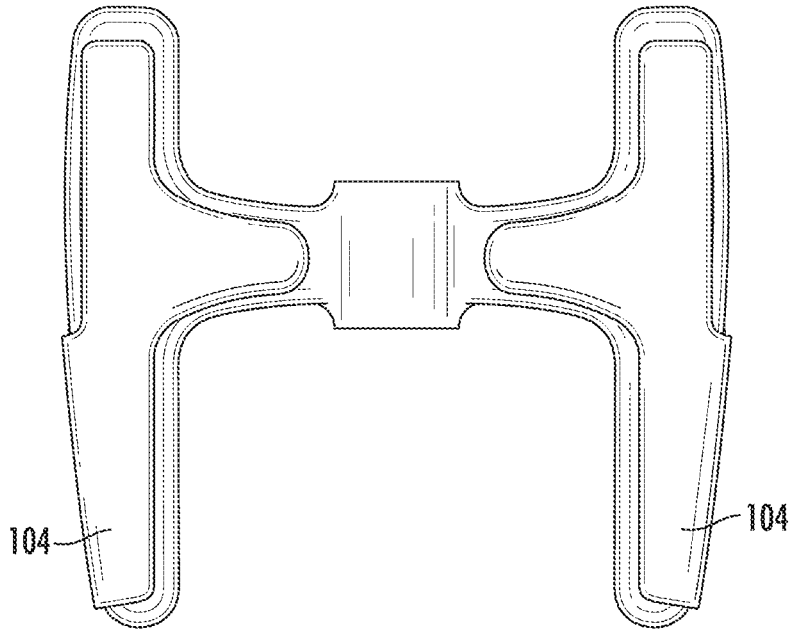
FIG. 22 is a top view of the face and eyewash sprayhead of FIG. 19.
Figure 23:
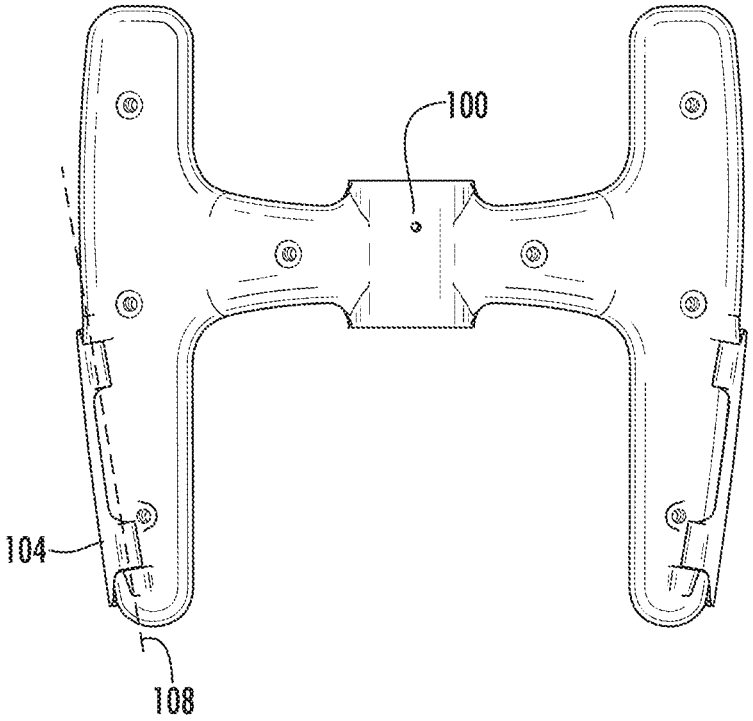
FIG. 23 is a bottom view of the face and eyewash sprayhead of FIG. 19.
Figure 24:
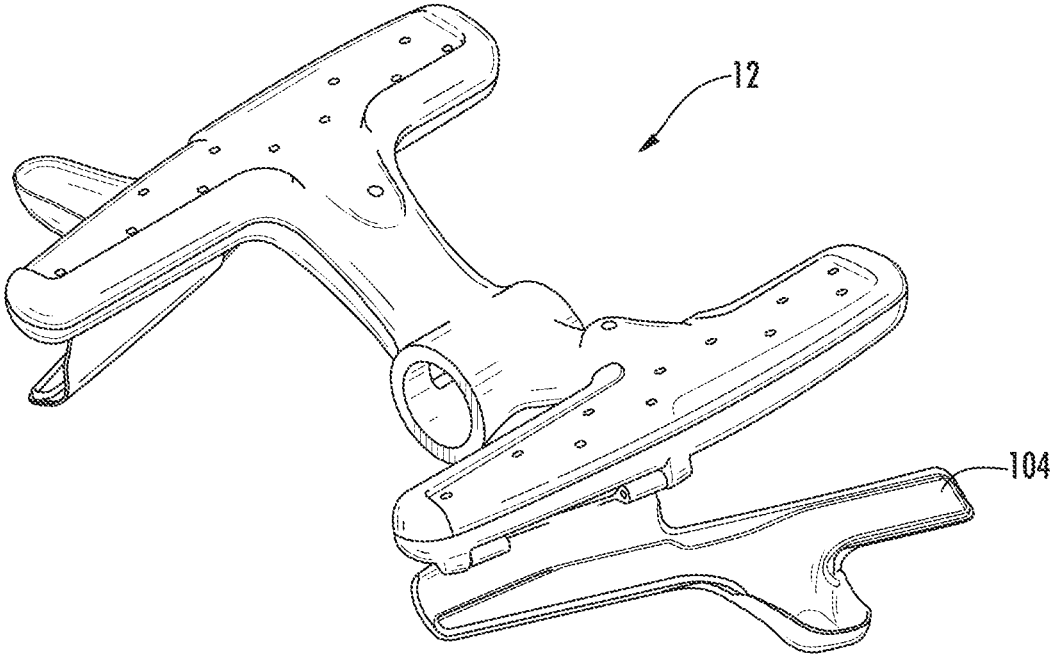
FIG. 24 is an isometric view of the face and eyewash sprayhead of FIG. 19 shown with the dust covers in a deployed position.
Figure 25:
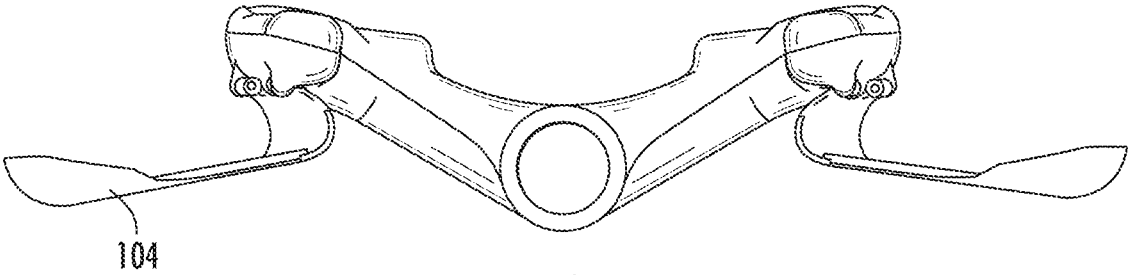
FIG. 25 is a front view of the face and eyewash sprayhead of FIG. 24.
Figure 26:
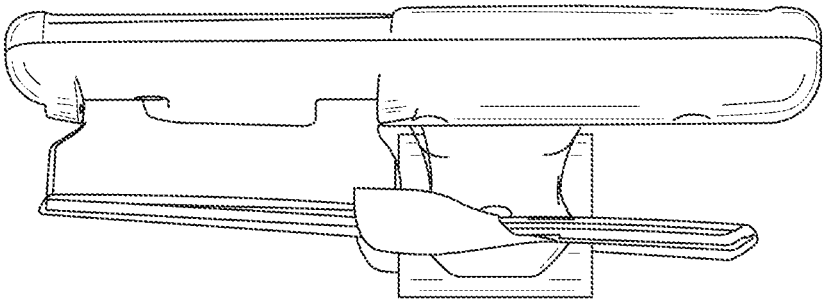
FIG. 26 is a side view of the face and eyewash sprayhead of FIG. 24.
Figure 27:
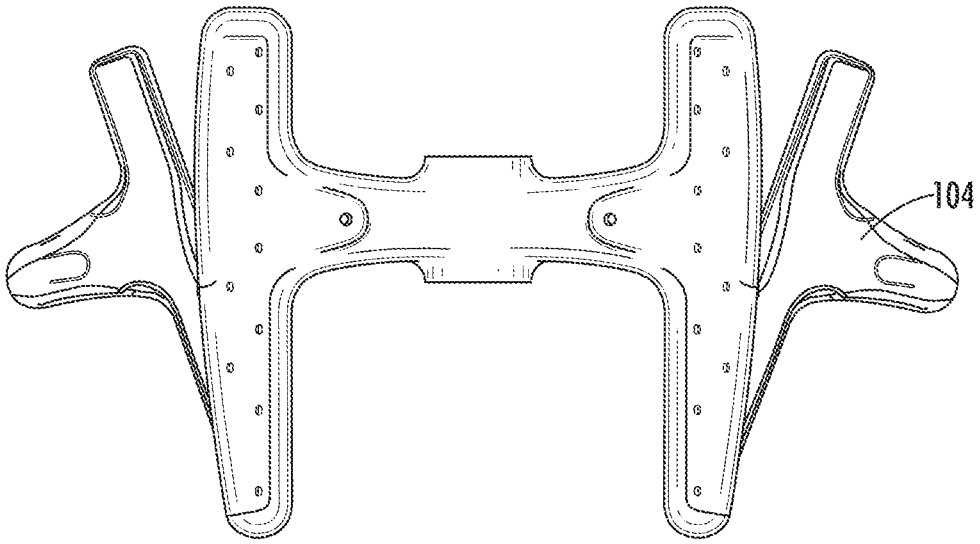
FIG. 27 is a top view of the face and eyewash sprayhead of FIG. 24.
Figure 28:
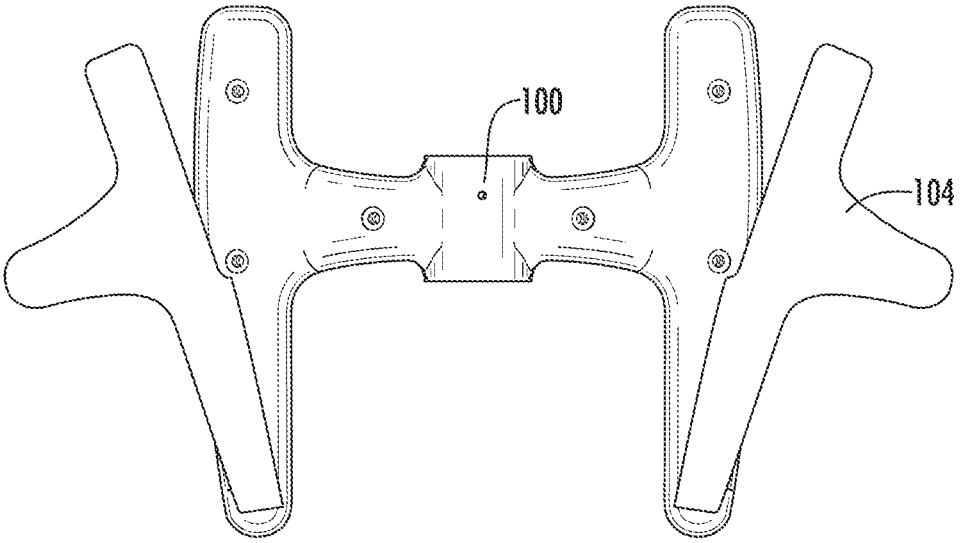
FIG. 28 is a bottom view of the face and eyewash sprayhead of FIG. 24
Figure 29:
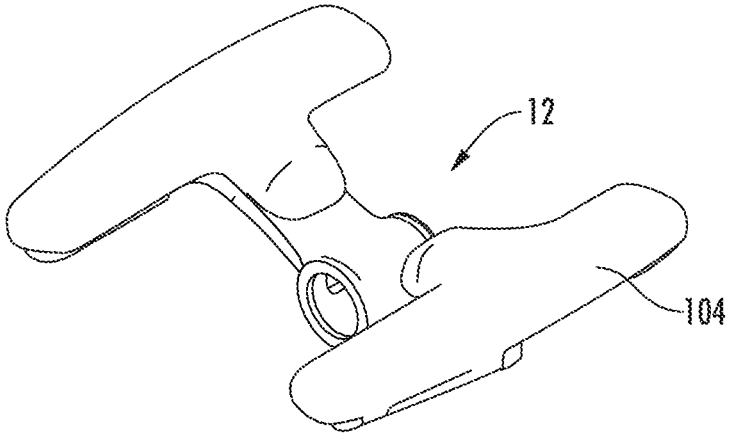
FIG. 29 is an isometric view of the face and eyewash sprayhead of FIG. 11 shown with a pair of dust covers in a closed position according to another exemplary embodiment.
Figure 30:
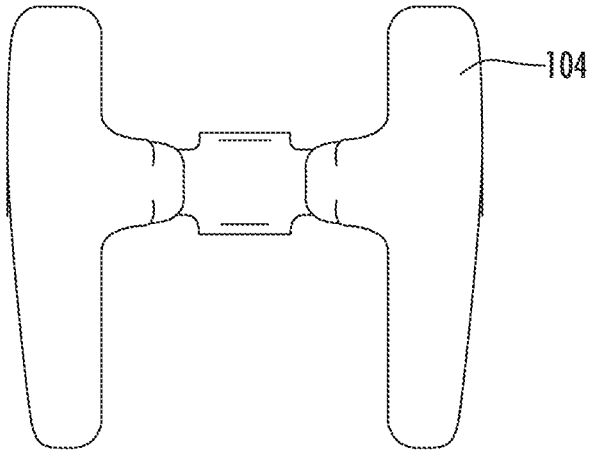
FIG. 30 is a top view of the face and eyewash sprayhead of FIG. 29.
Figure 31:
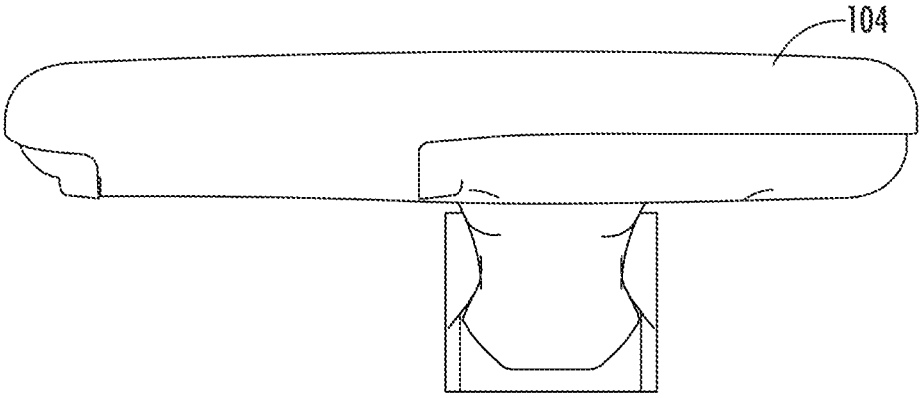
FIG. 31 is a side view of the face and eyewash sprayhead of FIG. 29.
Figure 32:
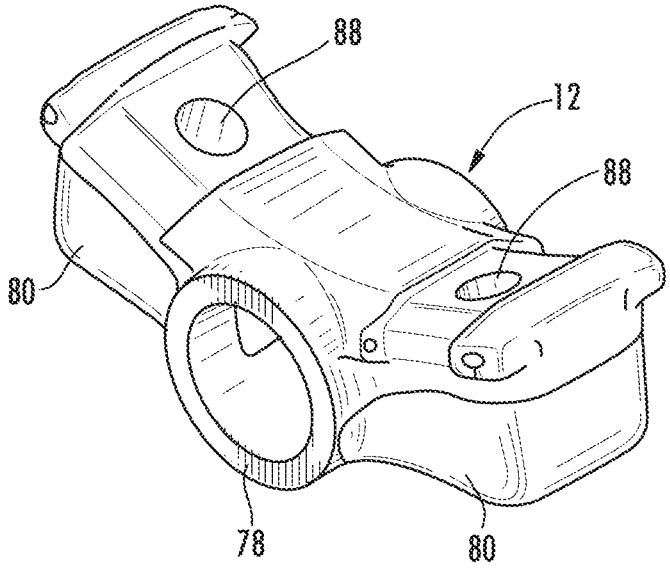
FIG. 32 is an isometric view of an eyewash sprayhead for the emergency wash system of FIG. 1 shown according to an exemplary embodiment.
Figure 33:
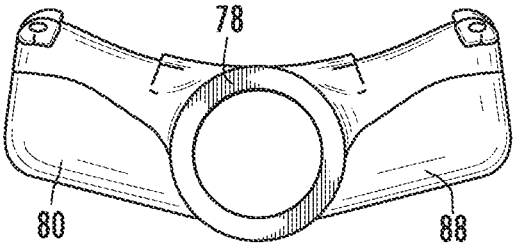
FIG. 33 is a front view of the eyewash sprayhead of FIG. 32.
Figure 34:
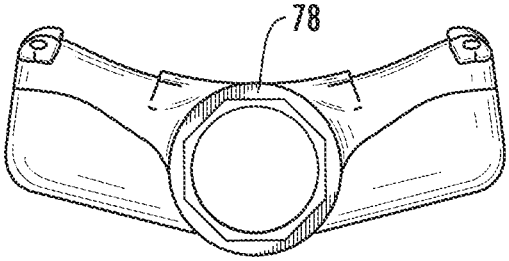
FIG. 34 is a rear view of the eyewash sprayhead of FIG. 32.
Figure 35:
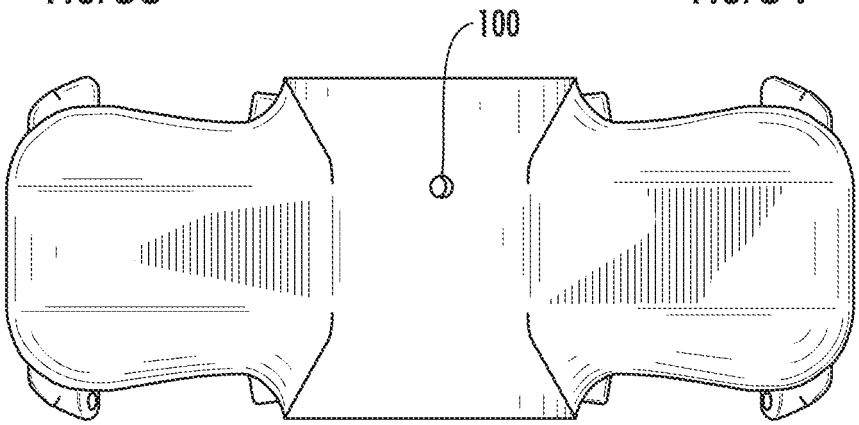
FIG. 35 is a bottom view of the eyewash sprayhead of FIG. 32.
Figure 36:
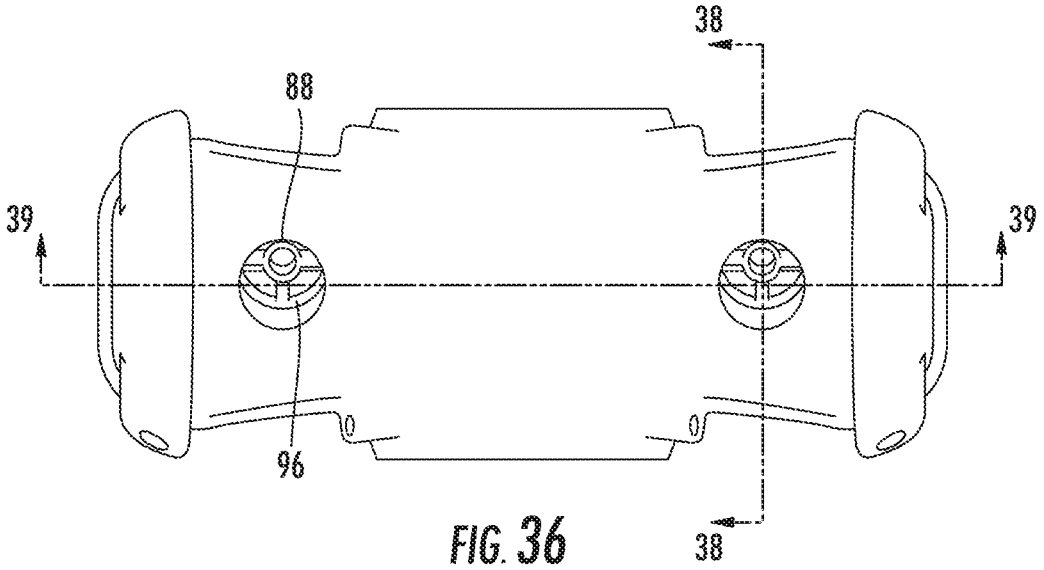
FIG. 36 is a top view of the face and eyewash sprayhead of FIG. 32.
Figure 37:
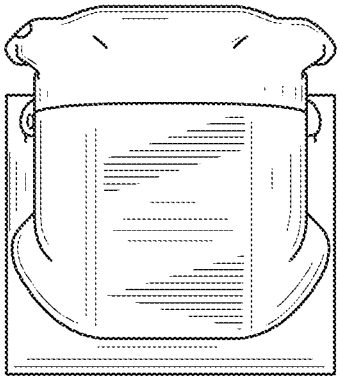
FIG. 37 is a side view of the eyewash sprayhead of FIG. 32.
Figure 38:
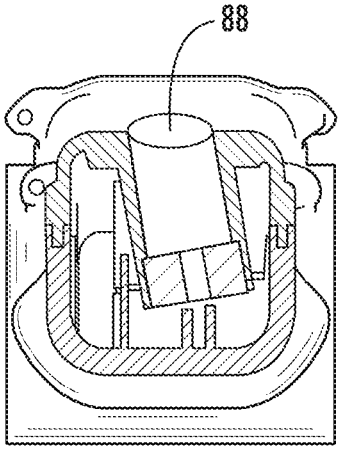
FIG. 38 is a sectional view of the eyewash sprayhead of FIG. 32 taken along line 38-38 in FIG. 36.
Figure 39:
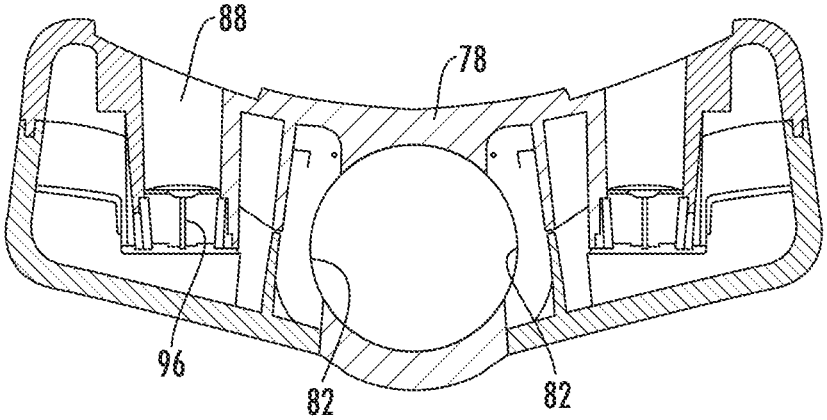
FIG. 39 is another sectional view of the eyewash sprayhead of FIG. 32 taken along line 39-39 in FIG. 36.
Figure 40:
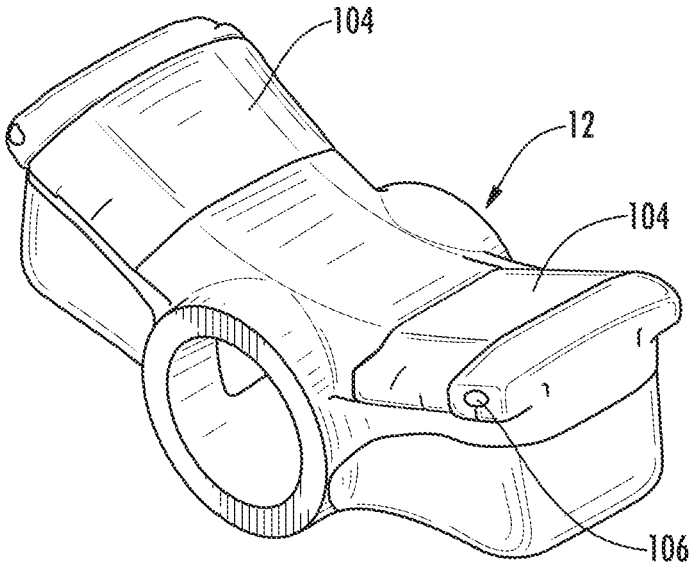
FIG. 40 is an isometric view of the eyewash sprayhead of FIG. 32 shown with dust covers in a closed position according to an exemplary embodiment.
Figure 41:
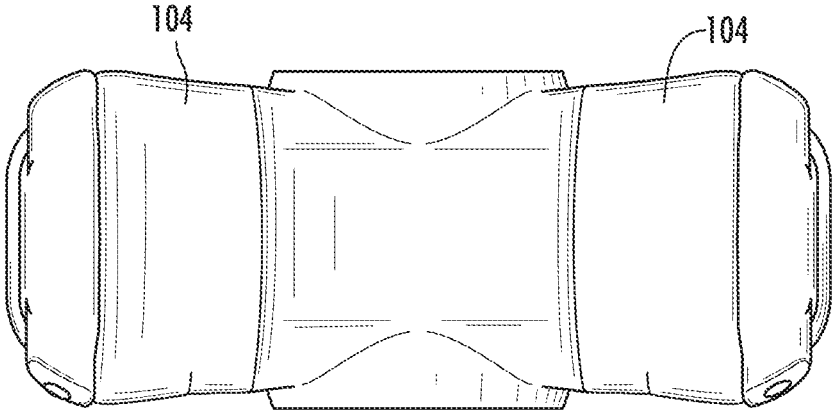
FIG. 41 is a top view of the eyewash sprayhead of FIG. 40.
Figure 42:
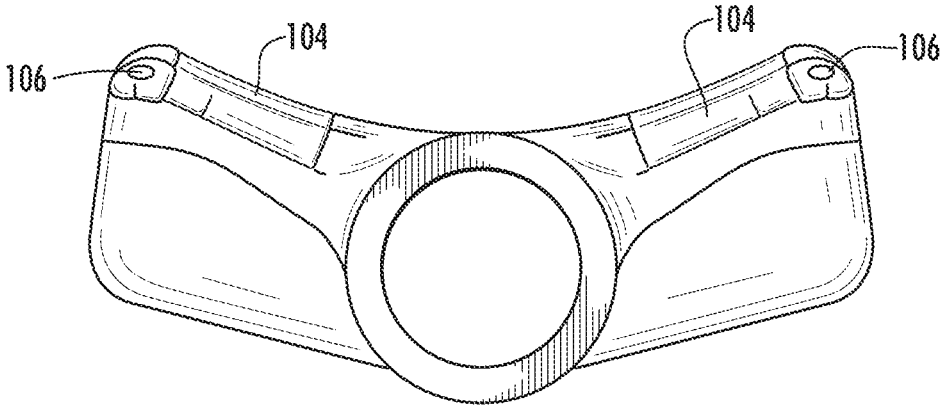
FIG. 42 is a front view of the eyewash sprayhead of FIG. 40.
Figure 43:
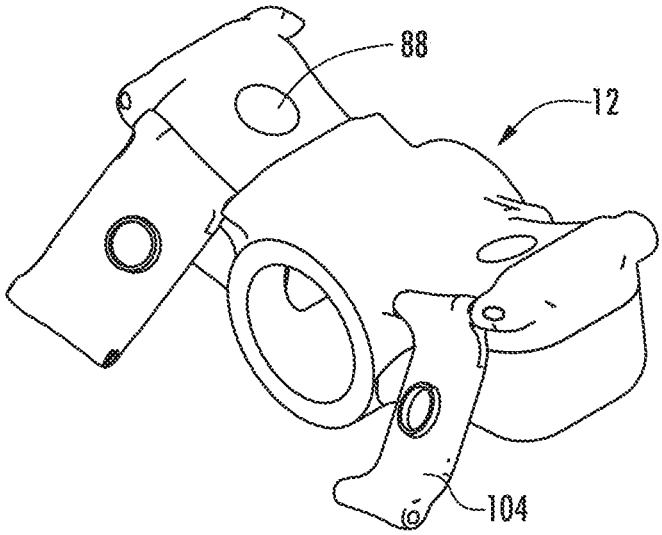
FIG. 43 is an isometric view of the eyewash sprayhead of FIG. 40 shown with the dust covers in an open position.
Figure 44:
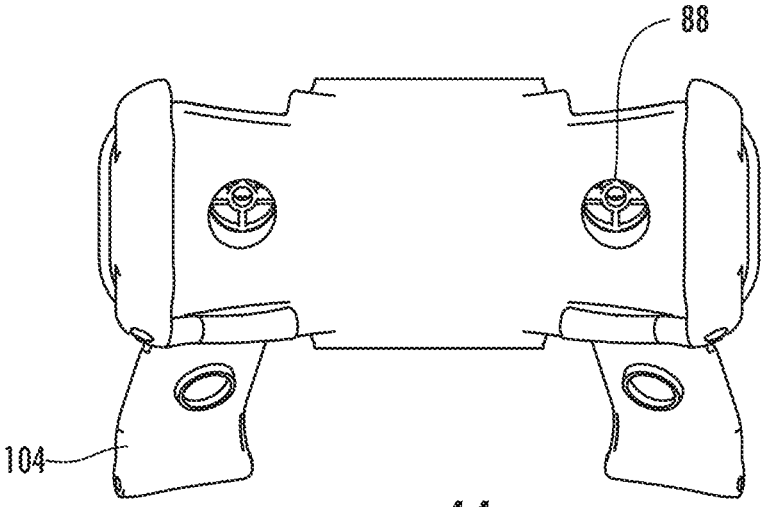
FIG. 44 is a top view of the eyewash sprayhead of FIG. 43.
Figure 45:
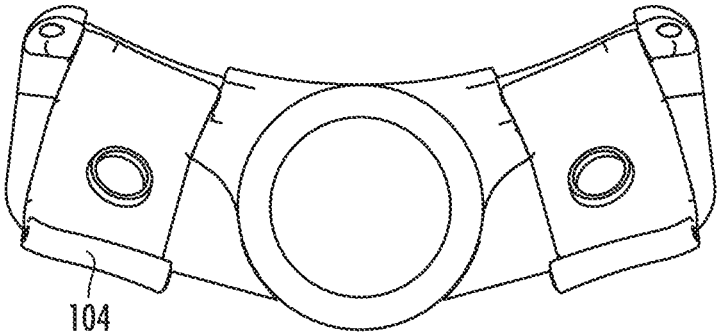
FIG. 45 is a front view of eyewash sprayhead of FIG. 43.
Figure 46:
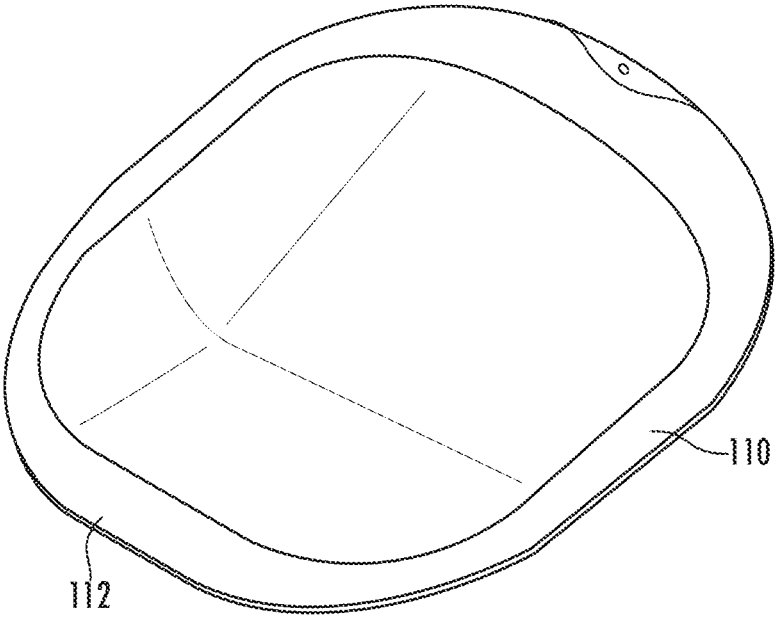
FIG. 46 is an isometric view of a cover of the emergency wash system of FIG. 1 shown according to an exemplary embodiment.
Figure 47:
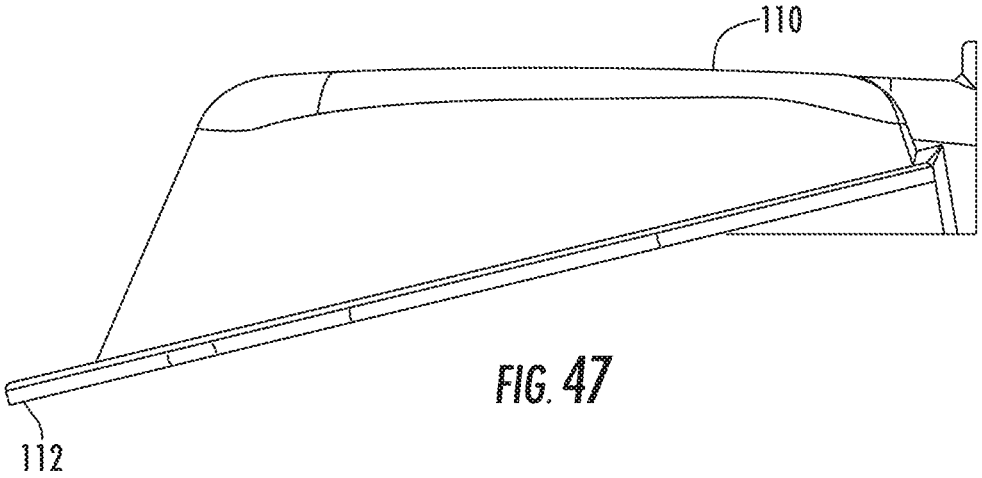
FIG. 47 is a side view of the cover of FIG. 46.
Figure 48:
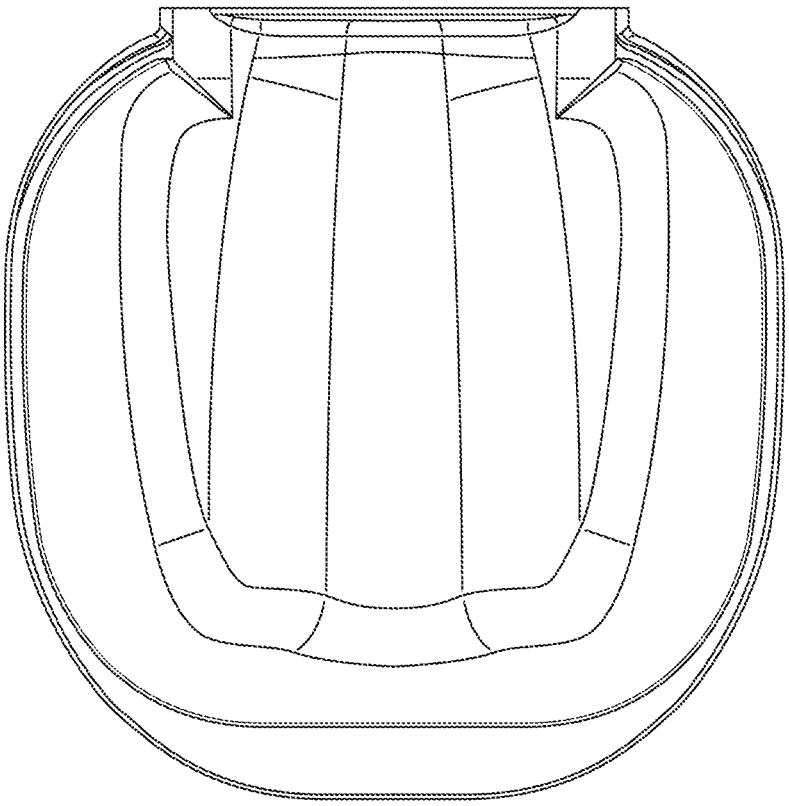
FIG. 48 is a top view of the cover of FIG. 46.
Figure 49:
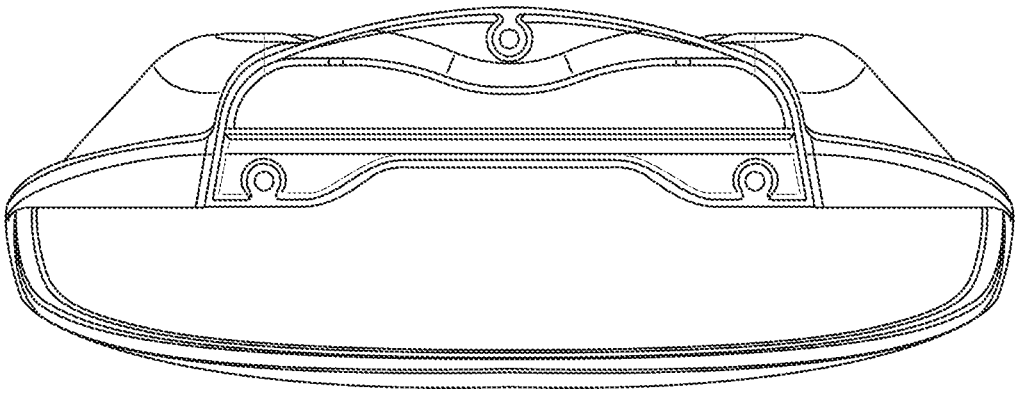
FIG. 49 is a back view of the cover of FIG. 46.

Referring to FIGS. 16-18, and according to an exemplary embodiment, the direction of the fluid stream emerging from the apertures flows along an axis 90 that is different than the axis 92 of the hole. According to the embodiment illustrated, the direction of the stream exiting the apertures is controlled by a passageway leading to the surface of the sprayhead. The passageway includes one or more undercuts or ramps 94 that influence the direction of the stream upon exiting the aperture. The ramps are used, in place of angled holes, in an effort to reduce manufacturing costs and/or simplify the manufacturing process. According to an exemplary embodiment, the sprayhead 12 is formed by an injection molding process. Because it may be desirable to vary the direction of the fluid stream exiting one or more of the apertures relative to a surrounding aperture, the tooling cost would be significant if the apertures were formed with a mold pin that was retracted at an angle. Instead, the ramps 94 are formed by a mold pin that is configured to be retracted in a substantially straight direction. The end of the mold pin is angled on one or more surfaces to form the desired ramps in the passageway.

The direction of the stream of the water emerging from the sprayhead 12 can be controlled using any of a variety of techniques. For example, referring to the sprayhead 12 shown in FIGS. 32-45, one or more baffles 96 are provided in the apertures 88 to help direct the fluid stream emerging from the apertures. According to the various alternative embodiments, the directional output stream of the water can be controlled by using individual nozzles at each aperture, by using angled holes or by any other suitable technique.

The inner cavity of the sprayhead 12 may also include one of more features to control the movement of the water as the water travels through the sprayhead. Such features may be able to focus the water to a particular portion of the sprayhead 12 and/or may be used to slow down the flow of the water as the water enters the sprayhead 12. According to the embodiment illustrated in FIG. 16, the sprayhead 12 includes a series of projections or baffles 98 to disrupt the flow of water as the water enters the sprayhead 12. A first set of baffles are provided on one side of the central hub, while a second set of baffles are provided on an opposite side of the central hub. The baffles are shown as being formed on the upper portion of the sprayhead 12 and extending downward. According to the various alternative embodiments, the baffles may also be formed on the lower portion of the sprayhead and extend upward.

The emergency wash system 10 also includes a drain that is on the fluid supply side of the system. The drain is provided to prevent stagnant water from collecting within the sprayhead and/or the fluid supply line (conduit) between the valve and the sprayhead. Eliminating the collection of stagnant water may reduce the likelihood that bacteria, mold or other undesirable organisms will form within the sprayhead and/or the fluid supply line. Eliminating the collection of stagnant water may also prevent stagnant water within the system from interfering with the operation of the emergency wash system 10 when it is activated. According to an exemplary embodiment, the drain is provided at substantially the lowest point on the fluid inlet assembly. Providing the drain at the lowest point of fluid inlet assembly allows the drain to be self-draining via gravity (meaning that the drain will function without being selectively activated). According to the embodiment illustrated, the drain is an aperture 100 (e.g., weep hole, etc.) defined by the sprayhead 12. Specifically, the drain is provided in a bottom portion of the hub and points downward towards the bottom of the basin. While the aperture 100 is provided at substantially the lowest point on the fluid inlet assembly, the aperture 100 is located above the lowest top edge of the basin 14 (e.g., the flood rim, lip, etc.). According to the embodiment illustrated, the lowest top edge of the basin 14 is the front edge. In such an embodiment, the aperture 100 is provided approximately one inch above the front top edge of the basin. Such a configuration ensures that if the basin 14 was to become full of waste water, the waste water would not siphon back into the fluid inlet supply line.

According to the embodiment illustrated, the aperture 100 is a relatively small opening having a substantially circular cross section. While a stream of water will flow through the drain aperture 100 during operation of the emergency wash system 10, the configuration of the aperture (e.g., size, shape, angle, etc.) is selected so that the drain does not substantially decrease the pressure within the system when the valve 44 is opened. This ensures that a sufficient amount of water, at a sufficient water pressure, will be able to exit the apertures 86 and/or 88 in the sprayhead 12. According to the various alternative embodiments, a valve (e.g., weep valve, etc.) could be added the drain to prevent or reduce the amount of water passing through the valve when the emergency wash system 10 is activated.

According to an exemplary embodiment, the upper surface of the sprayhead 12 is configured so that water will not collect on top of the surface after the valve 44 is closed and the flow of water stops. Such an embodiment enables the upper surfaces of the sprayheads 12 to be self-draining. According to the embodiment illustrated, the upper surface of the sprayhead includes recesses (e.g., indentations, etc.) and ridges 102 that direct the water off the upper surface of the sprayhead. According to the embodiment illustrated in FIGS. 11-28, dust covers 104 are shaped and sized to fit within the footprint defined by the ridges and recesses.

Referring to FIGS. 19-31, dust covers 104 are provided on each of the longitudinally elongated portions 84 of the sprayhead 12. The dust covers 104 are moveable between a first position and a second position. The dust covers 104 are configured to cover the apertures 86, 88 in the sprayhead 12 when in the first position and to reveal the apertures 86, 88 when in the second position. According to an exemplary embodiment, the dust covers 104 are configured to remain coupled to the sprayheads 12 when moving between the first position and the second position. For example, according to the embodiment illustrated, the dust covers 104 are coupled to the sprayhead 12 about a hinge 106 (having a hinge pin or shaft) defining a pivot axis 108 and are configured to rotate about the pivot axis 108 between the first position and the second position. The position of the hinge 106 is configured to remain fixed relative to the sprayhead 12.

Each elongated portion 84 of the sprayhead 12 generally defines a longitudinal axis or an axis that otherwise extends from the front to back. According to an exemplary embodiment, the pivot axis 108 of the dust cover is angularly offset from the longitudinal axis of the elongated (or the centerline of the sprayhead). For example, the pivot axis 108 a configured to converge towards a centerline of the sprayhead 12 at the back of the sprayhead 12. The angle of the hinge 106 relative to the longitudinal axis of the elongated portion 84 and/or the centerline of the sprayhead 12 may vary on the application and on a number of factors (e.g., the orientation of the elongated portion relative to the centerline of the sprayhead, the weight of the dust cover, the size of the dust cover, the shape of the dust cover, etc.).

Angling the axis of rotation of the dust covers 104 relative to the longitudinal axis of their respective elongated portion and/or relative to the centerline of the sprayhead 12 may be particularly beneficial for situations where the sprayhead 12 is used in a swing down application. In a swing down application, the sprayhead 12 is supported in a substantially vertical position when stowed and not in use. When a user activates such a system, the sprayhead 12 is rotated approximately ninety (90) degrees until the sprayhead 12 is supported in a substantially horizontal position. In the horizontal position, the sprayhead 12 is configured to operate similar to the embodiment illustrated and dispense a fluid for flushing irritants from the user. When the sprayhead 12 is being supported in a vertical position, the angled orientation of the hinge 106 assists in keeping the dust covers 104 over the elongated portions. The hinges 106 are aligned so that the weight of the dust covers 104 themselves bias the dust covers 104 towards the stowed position (over the elongated portions) when the sprayhead is supported in a substantially vertical position. This provides a positive closure of the dust covers 104 when the emergency wash system 10 is in the vertical position.

According to the various alternative embodiments, the dust covers 104 maybe configured to return to the first position after being deployed and after having the valve 44 moved to the closed position. For example, a biasing element (e.g., spring, etc.) may be provided between the dust cover 104 and the sprayhead 12 for biasing the dust cover 104 towards the first position. In such an embodiment, the water pressure would be sufficient to overcome the force of the biasing element. According to still further alternative embodiments, the emergency wash system 10 may include dust covers that are tethered to the sprayhead 12 and/or removably coupled to the sprayhead 12.

Referring to FIGS. 40-45, for the eye wash only sprayhead 12, the dust covers 104 are coupled to the sprayhead 12 about hinges 106 that are provided along a front edge of the sprayhead 12. Because the length of the dust covers 104 for the eye wash sprayhead are substantially shorter than the length of the dust covers 104 for the combination eye wash and face wash sprayhead (and thus, have reduced weight and/or a smaller moment arm), the hinge 106 can be provided at the end of the dust cover 104 rather than along the side of the dust cover 104. According to the embodiment illustrated, the hinge 106 includes a pivot pin defining an axis of rotation for the dust covers that is substantially perpendicular to the centerline of the sprayhead and/or the longitudinal axis of the central hub. When used with swing down applications, positioning the hinge along the front edge (rather than the back edge) ensures that the dust covers 104 will remain closed when the sprayhead 12 is supported in a substantially vertical position.

According to an exemplary embodiment, the emergency wash system 10 may optionally include a cover 110 that is configured to substantially enclose the sprayhead 12 and the basin 14 when in a closed position. The cover 110 may protect one or more features of the emergency wash system 10 (e.g., by keeping out contaminates, by preventing someone or something from accidently knocking into the components, etc.). Such a cover 110 may be optional because there are already dust covers provided on the sprayhead 12. However, providing such a cover may be desirable because the cover 110 itself may function as a user interface for activating the valve 44. For example, according to an exemplary embodiment, the cover 110 may be coupled to valve 44 so that the valve 44 is activated when a user moves the cover 110 to an open position.

According to an exemplary embodiment, the cover 110 is pivotally coupled relative to basin 14 and configured to be selectively moved by a user between a closed position and an open position. The cover 110 is moved between the closed position and the open position by having the user lift the cover 110 relative to the basin 14. To assist the user in lifting the cover 110, the cover 110 is shown as including a tab portion or flange 112 provided along a front portion of the cover 110 that is configured to be directly engaged by the user. As the user lifts the cover 110, the axis of the rotation of the cover 110 is the same as the axis of rotation of the valve stem 54. Further, the cover 110 is coupled directly to the valve 44 so that as the user lifts the cover 110, the valve 44 is simultaneously activated (e.g., opened, etc.). Such a configuration eliminates the need for any complicated linkage between the valve 44 and the cover 110. According to the embodiment illustrated, the cover 110 is mounted to the push plate 56 using one or more fasteners, which as detailed above is also directly coupled to the valve 44. Thus, the cover 110 can be added to the emergency wash system 10 without making any additional changes to the system.

It is important to note that the terms used herein are intended to be broad terms and not terms of limitation. These components may be used with any of a variety of products or arrangements and are not intended to be limited to use with emergency wash applications. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the emergency wash system as shown in the exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, injection molded acrylonitrile butadiene styrene ("ABS") are an exemplary method and material for making the basin, the sprayhead and the cover, but other materials can be used, including other thermoplastic resins such as polypropylene, high density polyethylene, other polyethylenes, polyurethane, nylon, any of a variety of homopolymer plastics, copolymer plastics, plastics with special additives, filled plastics, etc. The materials used to form such components may be transparent, translucent or opaque. Further, for components that may come into cover with a user (e.g., the sprayhead, cover, basin, etc.) an antimicrobial additive may be added to the material to help reduce bacteria growth on any such component. Also, other molding operations may be used to form these components, such as blow molding, rotational molding, etc. Components of the cover, sprayhead, basin and/or plumbing assembly can also be manufactured from cast or forged metal including but not limited to stainless steel or aluminum. Further, the emergency wash system 10 may be configured to be barrier free and/or in compliance with any applicable ADA requirements to accommodate users who may have special needs. For example, the clearance is provided between the basin and the floor may be limited to a particular height. Having the drain conduit exit the basin at a horizontal orientation may help simplify mounting the system at a particular height and/or may provide clearance underneath the basin that may be needed by a wheelchair user. Further still, the emergency wash system 10 may also include an overhead showerhead that drenches the body of a user. Accordingly, all such modifications are intended to be included within the scope of the appended claims. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An emergency wash system, comprising:

a basin;

a valve coupled to a fluid supply;

a fluid dispenser disposed at least partially over the basin and coupled to the valve, the fluid dispenser including:

a fluid inlet portion coupled to the valve;

a first fluid riser coupled to the fluid inlet portion, the first fluid riser extending upward from the fluid inlet portion;

a second fluid riser coupled to the fluid inlet portion, the second fluid riser extending upward from the fluid inlet portion and positioned on a substantially opposite side of the fluid inlet portion relative to the first fluid riser;

a first aperture defined by the first fluid riser; and a second aperture defined by the second fluid riser; and a push plate coupled to the valve, wherein the push plate is positioned substantially behind the fluid dispenser, and wherein the push plate is positioned at substantially a same vertical height as the fluid dispenser.

2. The emergency wash system of claim 1, wherein the push plate is configured to selectively open and close the valve.

3. The emergency wash system of claim 2, wherein the push plate is movable between a first position and a second position, the first position corresponding to the valve being closed and the second position corresponding to the valve being open.

4. The emergency wash system of claim 3, wherein the push plate is biased to the first position.

5. The emergency wash system of claim 1, wherein the push plate includes an indicia, the indicia instructing a user to push the push plate.

6. The emergency wash system of claim 1, wherein the basin further includes a top lip, and wherein the fluid dispenser is at least partially located above the top lip.

7. The emergency wash system of claim 1, further comprising a filter configured to filter the fluid prior to the fluid reaching the first and second apertures.

8. An eyewash sprayhead configured to selectively dispense fluid towards the eyes of a user, the eyewash sprayhead comprising:

a central hub;

a first fluid riser fluidly coupled to the central hub, the first fluid riser extending upward from the central hub and having a first aperture;

a second fluid riser fluidly coupled to the central hub and having a second aperture, the second fluid riser extending upward from the central hub on a substantially opposite side of the central hub relative to the first fluid riser; and a drainage aperture defined by the central hub, the drainage aperture configured to drain fluid from the central hub.

9. The eyewash sprayhead of claim 8, wherein the drainage aperture is located on a bottom portion of the central hub.

10. The eyewash sprayhead of claim 8, wherein the drainage aperture utilizes gravity to drain at least a portion of the fluid accumulated in the central hub.

11. The eyewash sprayhead of claim 8, wherein the drainage aperture is disposed between the first fluid riser and the second fluid riser.

12. The eyewash sprayhead of claim 8, wherein the drainage aperture is located above a top edge of a basin and spaced apart from a lowest surface of the basin.

13. The eyewash sprayhead of claim 8, further comprising a filter disposed at least partly within the central hub.

14. The eyewash sprayhead of claim 8, wherein the central hub includes a sidewall defining a bore having a first end and a second end, the first end defining a fluid inlet portion for the eyewash sprayhead.

15. The eyewash sprayhead of claim 13, wherein the second end is configured to receive a cap configured to at least partly direct fluid to the first and second fluid risers.

16. An emergency wash system, comprising:

a basin;

a fluid dispenser disposed at least partially over the basin, the fluid dispenser including:

a fluid inlet portion defining a drainage aperture;

a first fluid riser fluidly coupled to the fluid inlet portion, the first fluid riser extending upward from the fluid inlet portion;

a second fluid riser fluidly coupled to the fluid inlet portion, the second fluid riser extending upward from the fluid inlet portion on a substantially opposite side of the fluid inlet portion relative to the first fluid riser; and a push plate coupled to the fluid dispenser, wherein the push plate is positioned behind the fluid dispenser, and wherein the push plate is positioned in substantial alignment with and behind the fluid dispenser.

17. The emergency wash system of claim 16, wherein the first fluid riser includes a first internal fluid passageway and the second fluid riser includes a second internal fluid passageway, and wherein a filter is configured to filter the fluid prior to the fluid reaching the first and second internal fluid passageways.

18. An emergency wash system comprising:

a basin;

a fluid dispenser disposed at least partially over the basin, the fluid dispenser including:

a fluid inlet portion defining a drainage aperture;

a first fluid riser fluidly coupled to the fluid inlet portion, the first fluid riser extending upward from the fluid inlet portion;

a second fluid riser fluidly coupled to the fluid inlet portion, the second fluid riser extending upward from the fluid inlet portion on a substantially opposite side of the fluid inlet portion relative to the first fluid riser; and a push plate coupled to the fluid dispenser, wherein the push plate is positioned behind the fluid dispenser; and wherein the drainage aperture is proximate to and spaced apart from a lower surface of the basin.

* * * * *